US011788372B2

(12) United States Patent
Andersen et al.

(10) Patent No.: US 11,788,372 B2
(45) Date of Patent: Oct. 17, 2023

(54) BOTTOM HOLE ASSEMBLY AND METHODS FOR THE UTILIZATION OF PRESSURIZED GAS AS AN ENERGY SOURCE FOR SEVERING SUBTERRANEAN TUBULARS

(71) Applicant: Gas and Oil Technologies LLC, Al-Khobar (SA)

(72) Inventors: Gunnar Andersen, Mathopen (NO); Sam Noam Schroit, Houston, TX (US); Jeffrey Bruce Wensrich, Houston, TX (US)

(73) Assignee: Gas and Oil Technologies LLC, Al-Khobar (SA)

( * ) Notice: Subject to any disclaimer, the term of this patent is extended or adjusted under 35 U.S.C. 154(b) by 0 days.

(21) Appl. No.: 17/714,175

(22) Filed: Apr. 6, 2022

(65) Prior Publication Data

US 2022/0341272 A1 Oct. 27, 2022

(30) Foreign Application Priority Data

Apr. 27, 2021 (NO) ..... 20210512

(51) Int. Cl.
*E21B 29/00* (2006.01)
*E21B 23/04* (2006.01)

(52) U.S. Cl.
CPC ..... *E21B 29/005* (2013.01); *E21B 23/04* (2013.01)

(58) Field of Classification Search
CPC ..... E21B 29/005; E21B 29/02
See application file for complete search history.

(56) References Cited

U.S. PATENT DOCUMENTS 3,353,612 A * 11/1967 Bannister ..... E21B 4/02 175/6
2014/0124191 A1* 5/2014 Hallundbæk ..... E21B 29/00 166/55.2
2018/0345445 A1* 12/2018 Bussear ..... B24B 33/022

* cited by examiner

*Primary Examiner* — Giovanna Wright
(74) *Attorney, Agent, or Firm* — Christian D. Abel

(57) ABSTRACT

A bottom hole assembly comprising a downhole tool known as a cutting tool is provided for use within a subterranean well for severing tubulars. The cutting tool comprises a fluid source, a gas-driven rotatable motor and a cutting head including one or more cutters. The fluid source supplies pressurized fluid and thereby energy to the gas-driven rotatable motor which is disposed to generate thrust to set the gas-driven rotatable motor in motion. The cutting head is coupled to the gas-driven rotatable motor and rotates while cutting the tubular. The cutting tool can be deployed in a subterranean well by a variety of deployment methods, and the pressurized fluid may be supplied from a surface system, generated inside the cutting tool or bottom hole assembly, or input within the cutting tool or bottom hole assembly prior to deployment.
The invention further relates to associated methods.

16 Claims, 35 Drawing Sheets

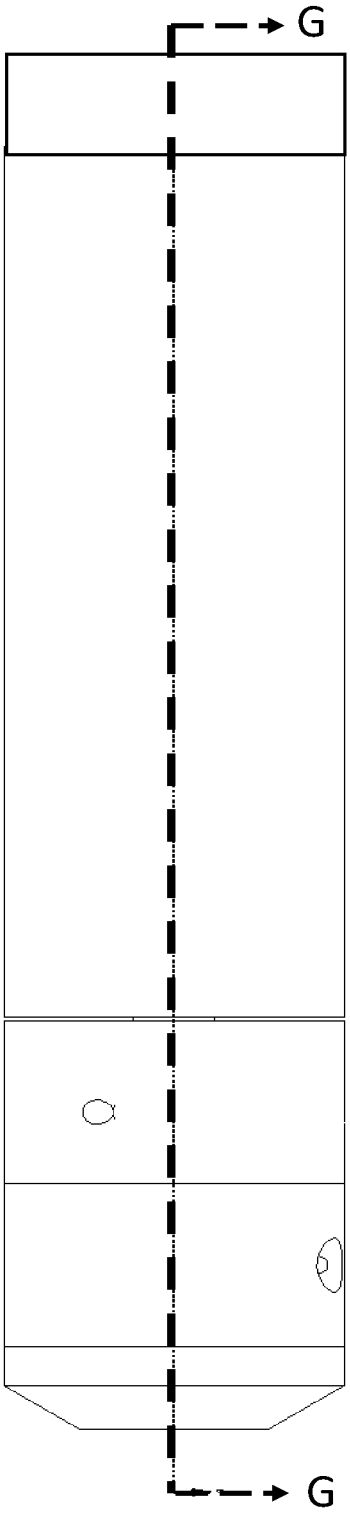
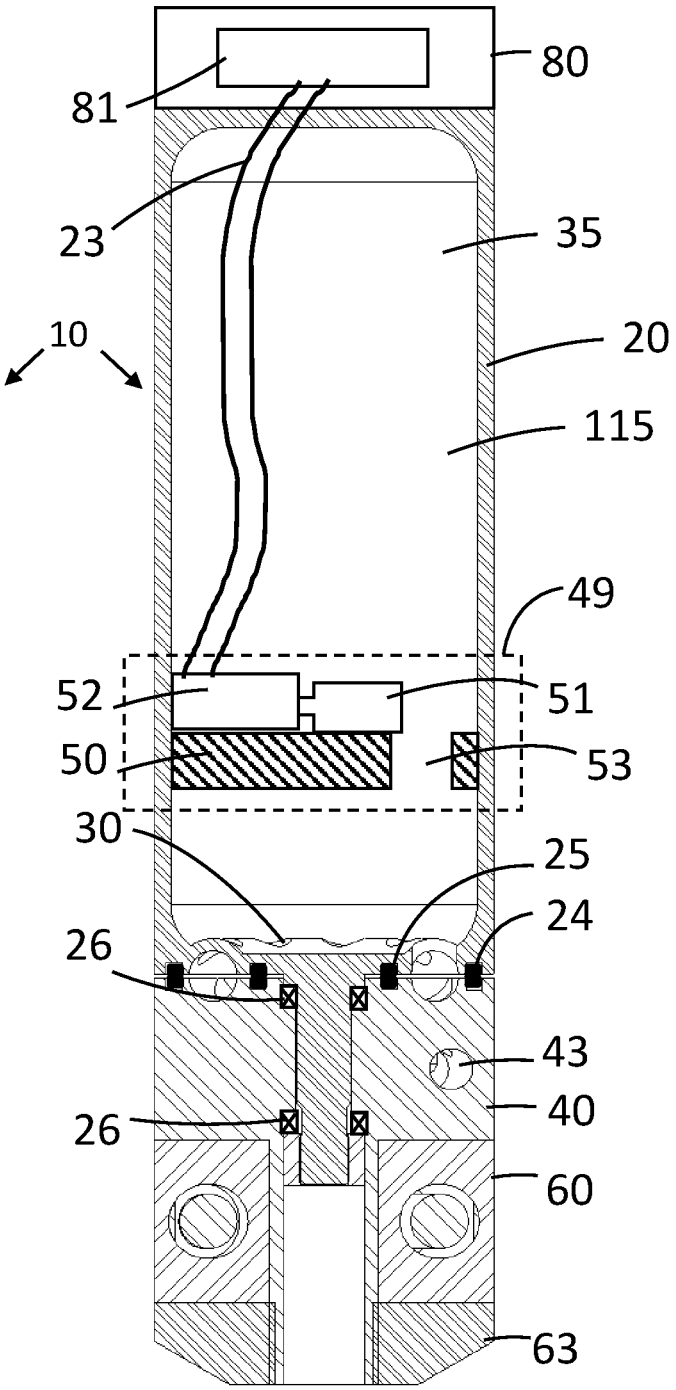
FIG. 13A
FIG. 13 B

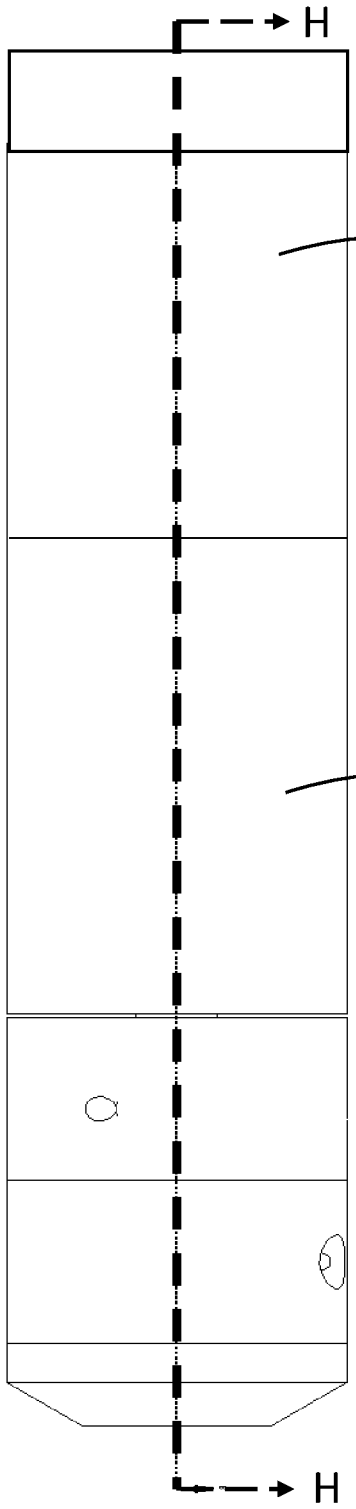
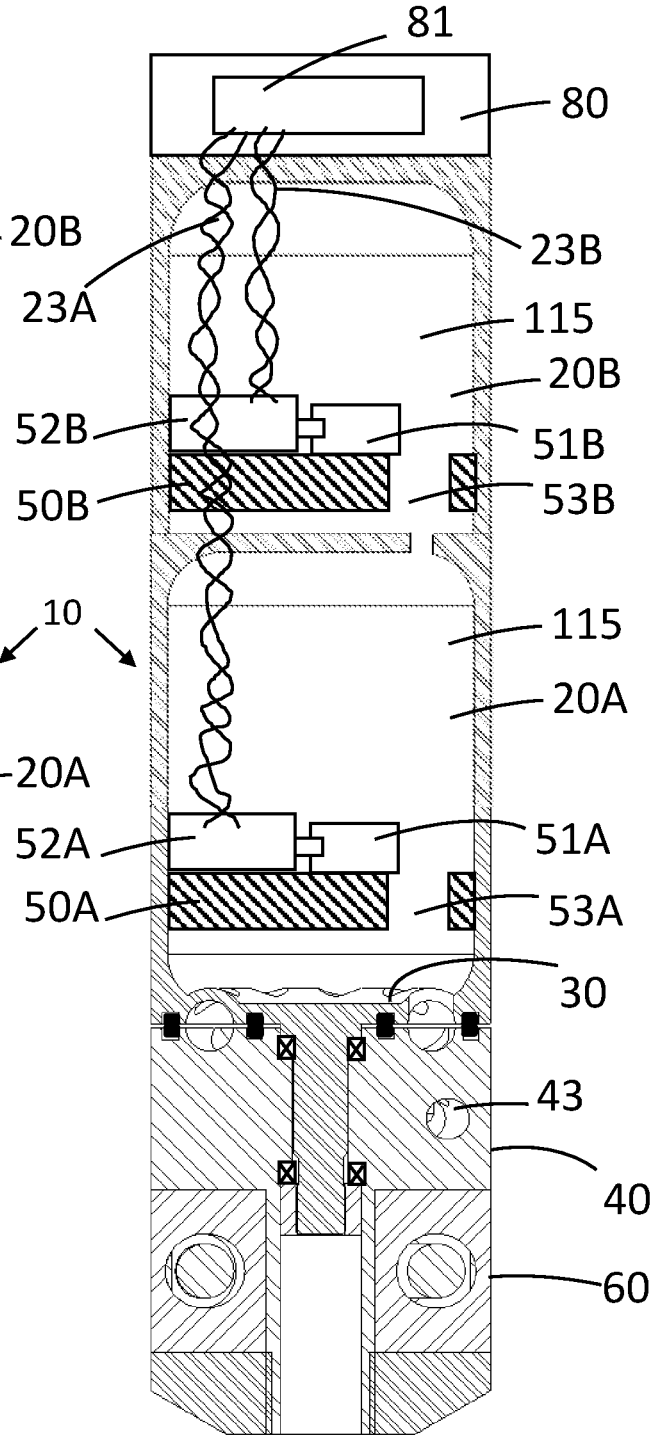
FIG. 15 A
FIG. 15 B

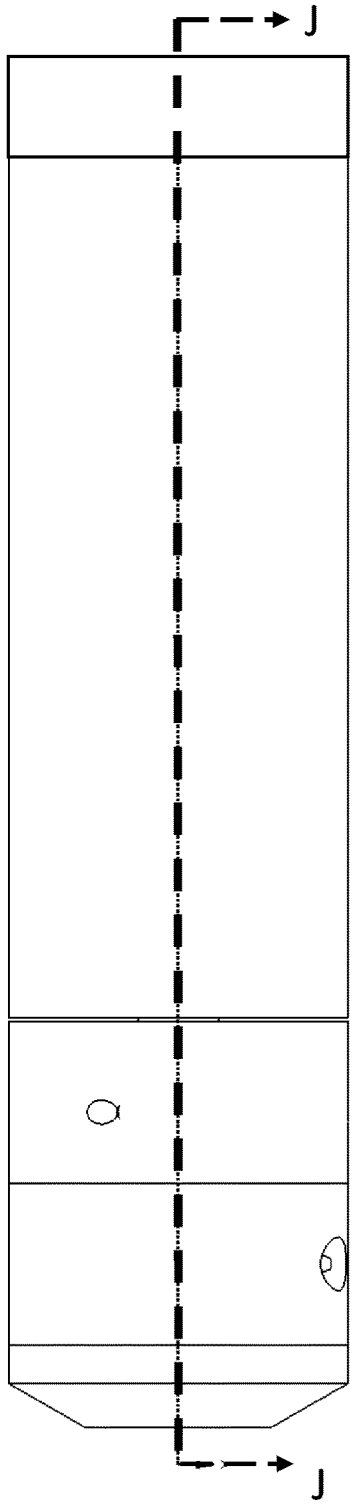
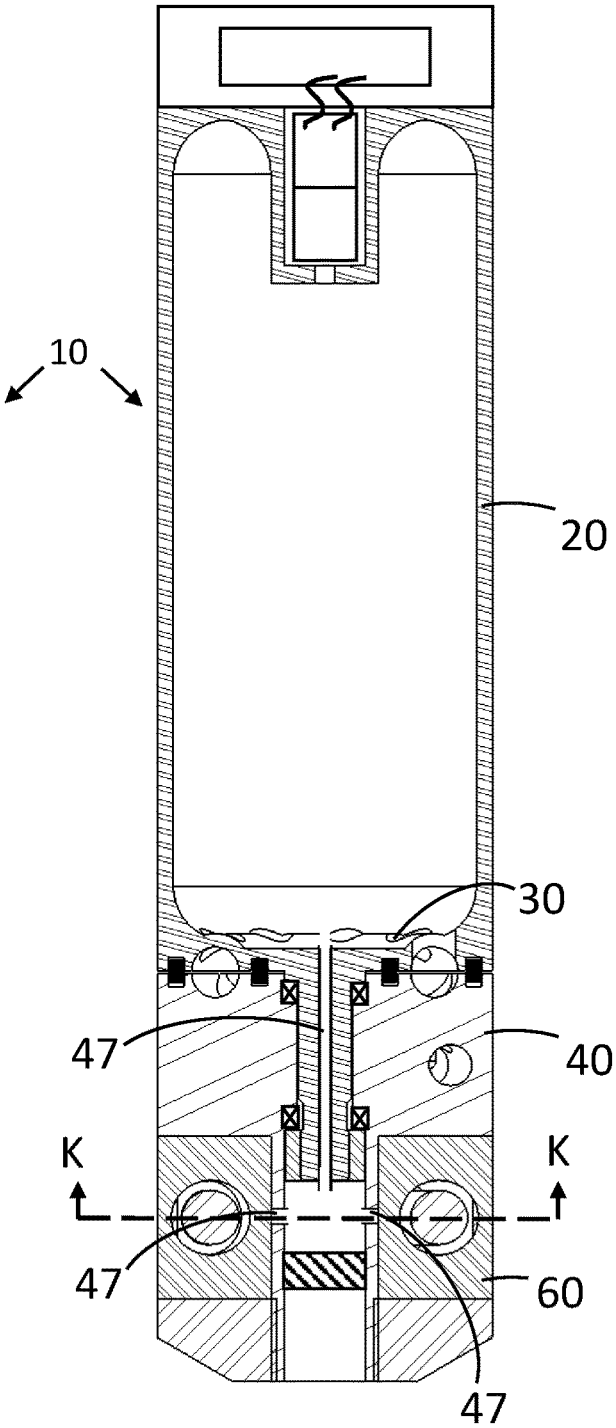
FIG. 16 A
FIG. 16 B

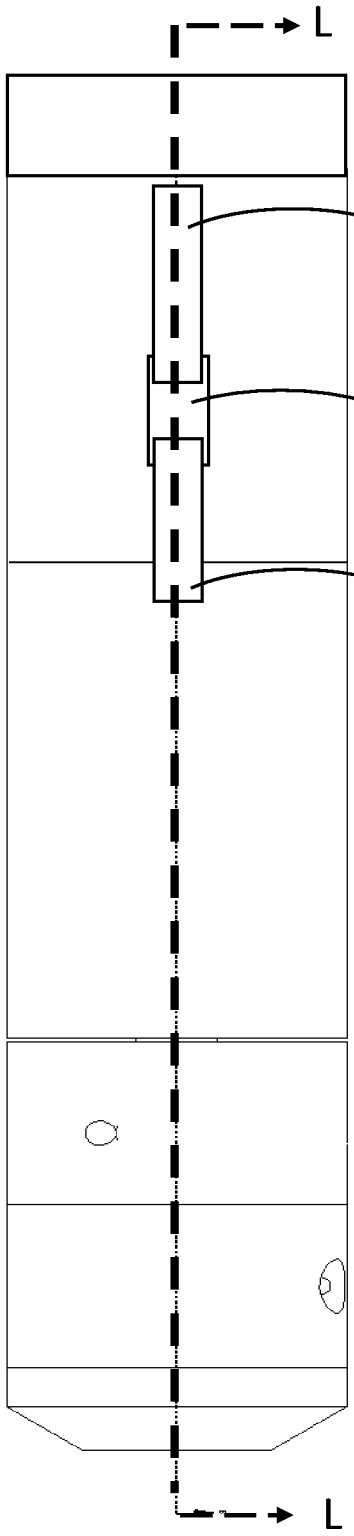
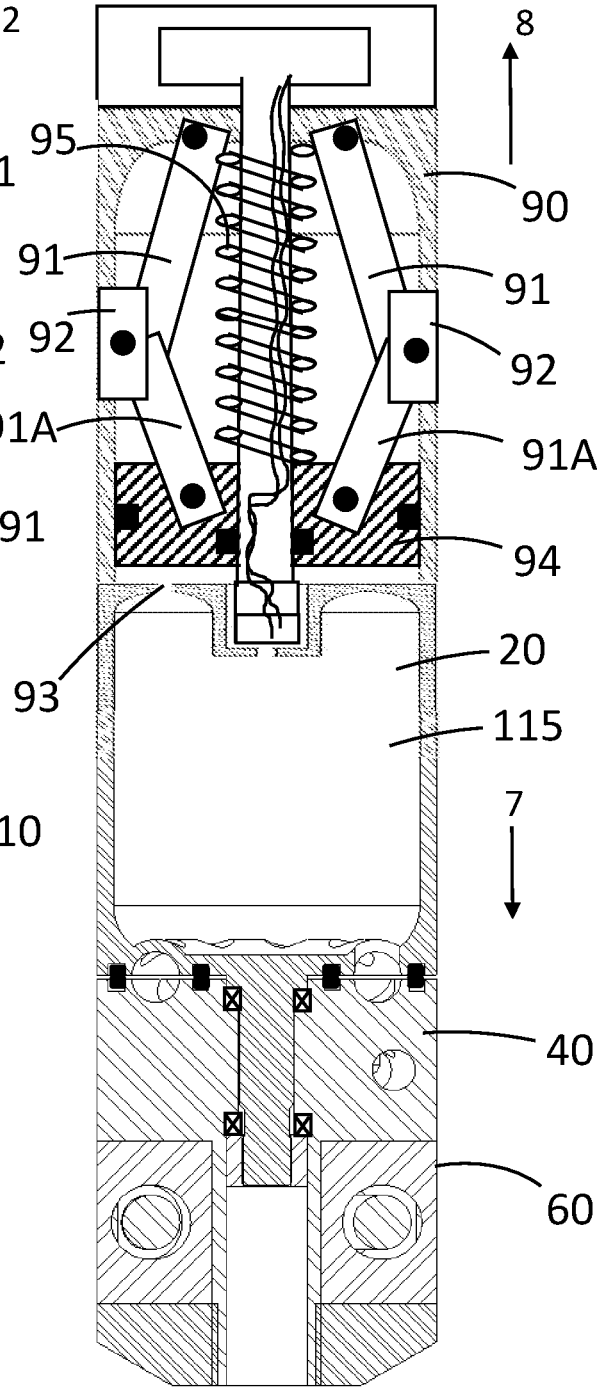
FIG. 19 A
FIG. 19 B

BOTTOM HOLE ASSEMBLY AND METHODS FOR THE UTILIZATION OF PRESSURIZED GAS AS AN ENERGY SOURCE FOR SEVERING SUBTERRANEAN TUBULARS

FIELD OF THE INVENTION

The invention relates to a bottom hole assembly comprising a cutting tool and associated methods that utilizes pressurized gas to power the cutting tool and sever a subterranean tubular or pipe into shorter and separate sections.

BACKGROUND OF THE INVENTION

There are several ways to sever/cut a tubular in a subterranean well, be it tubulars such as well tubing, well casings, drill pipes, snubbing pipe, coiled tubing or other pipe. The subterranean well would be found in an oil and/or gas field. The well may alternatively be a geothermal well, a water well or a well for mining/mineral exploration.

During certain stages of the life of a subterranean well/borehole, which often comprises a wellbore tubular lining the interior of the borehole and in most cases a tubular for production or injection; the tubular must be cut for various purposes. For example, during a drilling operation, should a drill pipe become stuck, an operation known as pipe recovery must be deployed to separate sections of free pipe from sections of stuck pipe. In other cases, due to failed tubing or during well abandonment, the tubing must be cut in several places so that it may be removed from the wellbore. In other cases, an outer tubular known as casing must be cut to facilitate other operations; for example, side-tracking or cementing. To achieve these cuts, a device, a downhole tool, must be lowered inside the tubular and remotely operated from surface to perform the cut.

Several types of downhole tools exist that may be deployed in a wellbore to produce cuts and sever wellbore tubulars. These tools use varying methods of delivering energy from the surface to the tool located at the cutting target.

As disclosed in U.S. Pat. Nos. 5,129,322 and 4,125,161; some downhole tools use chemicals and explosives to achieve a cut; for example, a downhole chemical cutter. A downhole chemical cutter is a downhole tool that expels a chemical at a high temperature and pressure to cut the wall of a tubular. A jet cutter is a downhole tool that uses a circular-shaped charge to produce a cutting action. A radial cutting torch is a downhole tool which radially ejects a plasma to produce a cut, and a drill collar severing tool is a downhole tool which uses explosive energy to sever the tubular. Such downhole tools suffer from the safety complexity of handling explosives and chemicals; however, offer a relatively inexpensive operational solution.

A hydraulic cutting tool is a downhole tool which is commonly deployed on drill pipe and powered with fluid pumped from surface to the downhole tool. These downhole tools present the disadvantage of being very expensive to deploy and often present imprecise and high-power utilizing cuts, as they usually require a full drilling rig or workover unit to operate.

An electric cutting tool such as those disclosed in U.S. Pat. Nos. 6,868,901 and 9,441,436 is a downhole tool which uses an electrical motor to drive a rotating head including a cutting blade or abrading component to cut the tubular. Electric cutting tools offer several advantages over chemical, explosive or hydraulic cutting tools; for example, they offer precise control of the cutting process and may provide an indication as to when a cut has been completed; however, these tools are often cost prohibitive.

Other prior art includes U.S. Pat. No. 4,819,728 A, US 2010258293 A1, U.S. Pat. No. 3,859,877 A, US 2004089450 A1 and GB 2124678 A.

A bottom hole assembly as is known in the art, is an apparatus that is adapted for use within a subterranean well/borehole that extends into the earth to reach a targeted subterranean formation that is expected to contain valuable hydrocarbons, such as oil, gas or combinations thereof, geothermal energy, water or minerals. A bottom hole assembly may be run into an existing borehole on a wireline that may provide a physical tether as well as provide connections for electrical power delivery and data communication between the bottom hole assembly and a computer system at the surface near the borehole. Furthermore, a bottom hole assembly may include one or more downhole tools, components or subsystems that perform one or more functions of the bottom hole assembly. Other means of deploying a bottom hole assembly, known in the art, are drill pipe, snubbing, coiled tubing, slick line, composite cables and ropes, all offering different operational methods and possibly equipped with various features, for example, hydraulic, electrical or fibre optic communication.

Certain downhole tools may include a cutting head. A cutting head may be activated to cut a downhole tubular to separate a section of lower tubular from a section of upper tubular. The cutting head may, using the deployment system, be repositioned within the borehole and reactivated to achieve multiple cuts per downhole operation.

A bottom hole assembly, comprising a downhole tool that includes a cutting head, may be deployed within the borehole, such that the cutting head may be activated at various locations therein. In this manner, the downhole tool including the cutting head may be used in conjunction with a drill pipe recovery, tubing recovery, casing cutting or other downhole tubular cutting operation or other process at one or multiple locations within the borehole.

SUMMARY OF THE INVENTION

The invention is set forth in the independent claims, where the dependent claims define other characteristics of the invention.

A bottom hole assembly is provided for cutting a pipe or tubular within a borehole that extends into a subterranean formation, wherein the bottom hole assembly comprises a holding tool for securing the bottom hole assembly to the pipe; and wherein the bottom hole assembly comprises a cutting tool, wherein the cutting tool comprises:

a pressure chamber;

a propellant;

an igniter configured to ignite the propellant;

a gas-driven rotatable motor comprising one or more fluid passages wherein each of the fluid passages are in fluid communication with an exterior of the bottom hole assembly;

a mechanical cutting head coupled to the gas-driven rotatable motor;

wherein the cutting tool is configured such that upon ignition of the propellant, a pressurized gas is developed in the pressure chamber which is received by the gas-driven rotatable motor, wherein the gas-driven rotatable motor is configured to generate a thrust rotating the gas-driven rotatable motor by exhausting the pressurized gas from the pressure chamber via the one or more fluid passages in the gas-driven rotatable motor to the exterior of the bottom hole assembly.

The cutting tool preferably comprises one or more cutters in the form of one or more cutting blades or one or more abrading component(s) described as cutters.

The cutting tool utilizes energy from the pressurized gas to cut the tubular. The pressurized gas, i.e. exhaust gas, exhausted from within the cutting tool to the exterior, via one or more fluid passages, causes a rotational motion of the mechanical cutting head, and any cutters attached thereto, of the cutting tool, relative the tubular. The rotational energy of the cutters and their mechanical interaction with the tubular is sufficient to sever the tubular.

The pressure chamber, the propellant, the igniter, the gas-driven rotatable motor and the mechanical cutting head, all components of the cutting tool; may be deployed in the borehole. The cutting tool may be deployed by any available deployment method known in the art being available to an operator; for example, slickline, electric line (E-line), coiled tubing, drill pipe, or another deployment method.

The holding tool may form part of the cutting tool. Alternatively, the holding tool may be arranged at another location of the bottom hole assembly than the cutting tool.

Furthermore, the cutting tool may be deployed as an integrated part of a larger bottom hole assembly comprising other tools. Examples of other tools are a holding tool; a casing collar locator (CCL) or any other type of locating tool, be it a logging tool or mechanical locating tool to position the cutting tool at the correct depth; strain gauges; pressure and temperature gauges; or tools meant for other mechanical operations or data acquisition in the subterranean well. A wellbore tractor may also be part of the bottom hole assembly.

When deployed in a subterranean well, the cutting tool, and if relevant, the rest of bottom hole assembly, shall be run in hole (RIH) to the depth of where the tubular or pipe is to be severed. Depending on the deployment method, there are several ways of verifying the correct depth, e.g. by using a locating tool in the form of a casing collar locator or a gamma ray tool (GR). When deployed by a method having the option of electrical or fibre optic communication with surface, a casing collar locator (CCL) and/or a gamma ray tool (GR) may be included as part of the bottom hole assembly and used for depth correlation. If deployed by a method not having the option of electrical or fibre optic communication to surface, measured depth provided by the deployment system must be used for depth correlation. This is a less accurate way of depth correlation compared to those offering communication to surface.

The energy needed to cause the holding tool to physically contact the inner wall of the pipe and secure the bottom hole assembly within and to the pipe; generate the rotational motion of the gas-driven rotatable motor, generate the rotational motion of the cutting head, extend the cutters and cut the pipe; is provided by the pressurized gas contained within the pressure chamber and generated from the combustion of the propellant.

In an embodiment, the propellant and the igniter configured to ignite the propellant, are in the pressure chamber.

In an alternative embodiment, the propellant and the igniter configured to ignite the propellant are located outside the pressure chamber and in fluid communication with the pressure chamber via a fluid passage.

In an embodiment, a second pressure chamber may be employed. The first pressure chamber configured to supply the holding tool with the pressurized gas and the second pressure chamber configured to supply the gas-driven rotatable motor and/or the cutting head with a second pressurized gas.

In an embodiment, a third pressure chamber may be employed when the second pressure chamber only provides the gas-driven rotatable motor with the second pressurized gas, the third pressure chamber configured to supply the cutting head with a third pressurized gas.

The holding tool, when activated, temporarily maintains the cutting tool and the bottom hole assembly to the inside of the pipe to be cut, i.e. the holding tool physically contacts the inner wall of the pipe and thereby creates friction between the bottom hole assembly and the inner wall of the pipe or tubular. Friction forces created prevent the bottom hole assembly from rotating inside the tubular. The holding tool also prevents any movement of the bottom hole assembly and cutting tool along the long axis of the wellbore.

In an embodiment, the holding tool is configured such that upon ignition of the propellant, the pressurized gas is received by the holding tool, thereby securing the bottom hole assembly to the pipe by activating the holding tool from a retracted position to an extended position against the pipe.

In an alternative embodiment the bottom hole assembly further comprises, a holding tool pressure chamber; a holding tool propellant; a holding tool igniter for igniting the holding tool propellant; wherein the holding tool is configured such that upon ignition of the holding tool propellant, the holding tool propellant generates a holding tool pressurized gas which is received by the holding tool pressure chamber, thereby activating the holding tool from a retracted position to an extended position against the pipe.

The holding tool may be biased in the retracted position and arranged such that when the holding tool receives the pressurized gas or the holding tool pressurized gas at a pressure at or above a holding tool set-point pressure, the holding tool is forced into the extended position against the pipe; and when the holding tool receives the pressurized gas or the holding tool pressurized gas at a pressure below the holding tool set-point pressure, the holding tool is in the retracted position or in a process of retracting.

The biasing of the holding tool may be enabled with one or more springs such that the one or more springs maintain the holding tool in the retracted position until the holding tool receives the pressurized gas or the holding tool pressurized gas at a pressure sufficient to overcome the spring force; and when the holding tool pressurized gas or the pressurized gas is at or above the holding tool set-point pressure, the holding tool is in the extended position against the pipe.

The holding tool set-point pressure may be greater than the surrounding borehole pressure.

The holding tool set-point pressure may be greater than the pressure needed to overcome the spring force of one or more springs maintaining the holding tool in a retracted position and activate the holding tool into an extended position.

When the holding tool is activated, two or more linkages may extend from the body of the holding tool to contact the inner wall of the pipe.

In an embodiment, the holding tool comprises two or more linkage assemblies.

In an embodiment, the holding tool may comprise holding pads. The holding pads may be in the form of slips, wherein the holding pads are disposed to physically contact the inner wall of the pipe.

In an embodiment, the bottom hole assembly may further include a second holding tool. The second holding tool may be arranged at a distance from the holding tool described above, and may, for example be arranged at an upper part of the bottom hole assembly.

In an embodiment, the bottom hole assembly is deployed via drill pipe and the drill pipe is a holding tool.

In an embodiment, the holding tool is equipped with an actuation piston, wherein a first side of the piston is exposed to wellbore pressure and a second side of the piston is exposed to the pressurized gas in the pressure chamber. The mechanical arrangement is such that when force caused by the pressure of the pressurized gas in the pressure chamber acting on the first side of the piston exceeds the force caused by the wellbore pressure acting on the second side of the piston, the holding tool will be activated and set.

In an embodiment, the holding tool set-point pressure is applied to a surface area to generate a force, the force greater than a spring force.

In a preferred embodiment, the propellant is made of a solid mass, i.e. a combustible solid, designed to combust and generate a gas upon ignition.

In an embodiment, the propellant is combustible while submerged in a liquid or well-fluid.

In the preferred embodiment, the gas generated from the combustion of the propellant is stored in a pressure chamber of fixed volume, hence the gas generates a pressure inside the pressure chamber due to the fixed volume and the rise in temperature caused by the combustion process.

In an embodiment, the gas generated from the combustion of the propellant is stored in a pressure chamber of variable volume; wherein the volume is controlled such that the pressure in the pressure chamber is constant over a period.

In an embodiment, the period is a period of time required to initiate and complete a cut in a tubular.

In an embodiment, the igniter is configured to receive electrical power from surface via a wireline cable/E-line.

In an embodiment, the bottom hole assembly further comprises one or more batteries, the igniter configured to receive electrical power from the one or more batteries.

In an embodiment, the gas-driven rotatable motor and thereby the mechanical cutting head are biased in a stationary position and arranged such that when the gas-driven rotatable motor receives the pressurized gas at a pressure above a motor set-point pressure, the gas-driven rotatable motor rotates together with the mechanical cutting head; and when the gas-driven rotatable motor receives the pressurized gas at a pressure below the motor set-point pressure, the gas-driven rotatable motor and thereby the mechanical cutting head does not rotate or is in a process of stopping rotation.

In an embodiment, the gas-driven rotatable motor may be biased using one or more pins, such that the one or more pins maintain the gas-driven rotatable motor stationary until the motor set-point pressure is sufficient to apply a force upon the one or more pins and shear the one or more pins.

In an embodiment, the gas-driven rotatable motor may be biased by a clutch, wherein the clutch prevents the rotational movement of the gas-driven rotatable motor until the pressure of the pressurized is at or above the motor set-point pressure and when the pressure of the pressurized gas is reduced below the below the motor set-point pressure, the clutch stops the rotation of the gas-driven rotational motor or begins a process of stopping the rotation of the gas-driven rotational motor.

In a preferred embodiment, the gas-driven rotatable motor may be biased with a spring-loaded clutch, the spring loaded clutch comprising; a piston, a spring, and a clutch plate configured to engage the gas-driven rotatable motor; the piston having a surface area, such that when the surface area is exposed to a pressure at or above the motor set-point pressure, the clutch plate is disengaged from the gas-driven rotatable motor, and when the surface area is exposed to a pressure below the motor set-point pressure, the clutch plate is engaged to the gas-driven rotatable motor and the gas-driven rotatable motor is stopped or is in a process of stopping rotation.

In an embodiment, the motor set-point pressure is greater than the surrounding borehole pressure.

In an embodiment, the motor set-point pressure is greater than the holding tool set-point pressure.

In an embodiment, the motor set-point pressure is equal to the holding tool set-point pressure.

The cutting head, which may be located at a lower end of the cutting tool, and thereby at a lower end of the bottom hole assembly, may be equipped with one or more cutters in the form of one or more cutting blades or one or more abrading component(s) described as cutters. During deployment in the borehole, the one or more cutters may be in an initial retracted position within the circumferential envelope of the cutting head.

In an embodiment, the one or more cutters are disposed to extend to a position outside the circumferential envelope of the cutting head due to the centrifugal force created by the rotation of the cutting head and thereby contact the inner wall of the pipe to be cut. This rotational motion of the one or more cutters then processes; for example, cuts, grinds or parts the material of the pipe to be cut until an upper portion of the pipe is separated from a lower portion of the pipe.

In an embodiment, the mechanical cutting head comprises at least one cutter, wherein the cutter is biased in a retracted position within a circumferential envelope of the cutting head and configured such that when the gas-driven rotatable motor and the mechanical cutting head rotate, the at least one cutter is in an extended position against the pipe; and when the gas-driven rotatable motor and the mechanical cutting head do not rotate, the at least one cutter is in the retracted position or in the process of retracting.

In an embodiment, the at least one cutter is biased in a retracted position within the circumferential envelope of the cutting head, and configured such that when pressurized gas from the pressure chamber applies a pressure to the cutter which is above a cutter set-point pressure, the cutter is in an extended position against the pipe; and when the pressurized gas from the pressure chamber applies a pressure to the cutter which is below the cutter set-point pressure, the at least one or more cutters are in the retracted position or in a process of retracting.

In an embodiment, the cutters may be equipped with a return spring wherein the spring force acts to retract the cutters to the retracted position within the circumferential envelope of the cutting head.

In an embodiment, the one or more cutters are biased in the retraction position using one or more pins, such that the one or more pins maintain the one or more cutters within the circumferential envelope of the cutting tool until the cutter set-point pressure is sufficient to apply a force upon the one or more pins and shear the one or more pins.

In an embodiment, the cutter set-point pressure is greater than the surrounding borehole pressure.

In an embodiment, the cutter set-point pressure is greater than the holding tool set-point pressure.

In an embodiment, the cutter set-point pressure is equal to the holding tool set-point pressure.

In an embodiment, the cutter set-point pressure is greater than the motor set-point pressure.

In an embodiment, the cutter set-point pressure is equal to the motor set-point pressure.

In an embodiment, the mechanical cutting head comprises at least one pivoted arm, wherein each arm is equipped with a cutter and biased in a retracted position within a circumferential envelope of the cutting head, such that when the gas-driven rotatable motor and the mechanical cutting head rotate, the at least one pivoted arm is in an extended position against the pipe; and when the gas-driven rotatable motor and the mechanical cutting head do not rotate, the at least one pivoted arm is in the retracted position or in the process of retracting.

In an embodiment, the one or more pivoted arms are connected to a piston which is configured to move thereby extending the one or more pivoted arms, and wherein the pivoted arms and the piston are biased in a retracted position within the circumferential envelope of the cutting head, and configured such that when the piston is subject to a pressurized gas above a piston set-point pressure, the one or more pivoted arms are in an extended position towards the pipe; and when the piston is subject to a pressurized gas below the piston set-point pressure, the one or more pivoted arms are in the retracted position or in a process of retracting and the cutters are not in contact with the pipe.

In an embodiment, the centrifugal force of the cutting head rotation, causes the pivoted arms, and the thereby the cutters, to extend outside the circumferential envelope of the cutting tool and thereby contact the inner wall of the pipe to be cut.

In an embodiment, the one or more pivoted arms are biased in the retracted position within the circumferential envelope of the cutting head by one or more springs.

In an embodiment, the one or more pivoted arms are configured with one or more return springs wherein the spring force acts to retract the one or more pivoted arms to the retracted position within the circumferential envelope of the cutting head.

In an embodiment, one or more springs are disposed to retract the one or more pivoted arms to the retracted position within the circumferential envelope of the cutting head.

In an embodiment, the one or more pivoted arms are biased in the retracted position using one or more pins, such that the one or more pins maintain the one or more pivoted arms within the circumferential envelope of the cutting head until the piston set-point pressure is sufficient to apply a force upon the one or more pins and shear the one or more pins.

In an embodiment, the piston set-point pressure is greater than the surrounding borehole pressure.

In an embodiment, the piston set-point pressure is greater than the holding tool set-point pressure.

In an embodiment, the piston set-point pressure is greater than the motor set-point pressure.

In an embodiment, the piston set-point pressure is less than the motor set-point pressure.

In an embodiment, the piston set-point pressure is equal to the motor set-point pressure.

In an embodiment, the fluid passages in the gas-driven rotatable motor comprise a first portion in fluid communication with the pressure chamber and a second portion in fluid communication with the exterior, wherein at least the second portion of the one or more fluid passages comprises a center axis and the second portions are spaced apart relative to any other second portion(s) of the other fluid passages, and the center axis of the second portion of each of the one or more fluid passages and a longitudinal axis of the gas-driven rotatable motor are skew lines.

The fluid passages are such that the gas-driven rotatable motor is configured to generate a thrust, and thereby rotation of the gas-driven rotatable motor by exhausting fluid from the one or more fluid passages.

In an embodiment the fluid passages may be arranged at an angle other than 90 degrees (non-radial) relative the borehole wall or tubular wall surrounding the bottom hole assembly. The fluid passages are preferably as tangential as possible to the exterior surface of the bottom hole assembly.

Skew lines are two lines that do not intersect and are not parallel.

In an embodiment, to minimize force from the thrust in the longitudinal direction, the long axis direction of the borehole, during cutting and thereby preventing or minimizing axial movement of the cutting tool during a cutting or severing operation, each of the center axes of the second portions extend in a plane predominantly perpendicular to the longitudinal axis of the gas-driven rotatable motor. Predominantly perpendicular may preferably be +/−20 degrees, more preferably +/−10 degrees, even more preferably +/−5 degrees, and even more preferably +/−1 degree relative a perpendicular plane to the longitudinal axis of the gas-driven rotatable motor.

In an embodiment, each of the second portions extend in the same plane.

In an embodiment, each of the second portions extend in predominantly the same plane.

In an alternative embodiment, the second portions may extend in different planes.

In an embodiment, the second portion of the one or more fluid passages comprises a nozzle.

In an embodiment, the nozzle is a convergent-divergent nozzle.

In an embodiment, a gearbox is located between the gas-driven rotatable motor and the mechanical cutting head, wherein the gearbox is configured to effectuate a change in a rotational speed of the mechanical cutting head relative to a rotational speed of the gas-driven rotatable motor.

In alternative embodiments, additional components may be located between the gas-drive rotatable motor and the mechanical cutting head.

In an embodiment, the gearbox decreases the speed of the cutting head, relative to the speed of the gas-driven rotatable motor.

In an embodiment, the gearbox increases the speed of the cutting head, relative to the speed of the gas-driven rotatable motor.

The speed is preferably measured using revolutions per minute (RPM).

In an embodiment, the gearbox is a hydraulic gearbox.

In a preferred embodiment, the gearbox is a mechanical gearbox.

In an embodiment, the bottom hole assembly comprises one or more valves for selectively controlling the flow of the pressurized gas from the pressure chamber or the holding tool pressure chamber to any one of the following components: the holding tool, the gas-driven rotatable motor, and the mechanical cutting head, thereby controlling activation and de-activation of said component(s) at their respective set-point pressure and allowing and stopping the flow of pressurized gas to any of said components, and wherein the one or more valves is configured to be in communication with a controller controlling the operation of the one or more valves.

In an embodiment, the bottom hole assembly comprises a first valve to control the flow of the pressurized gas to the gas driven rotatable motor and a second valve to control the flow of the pressurized gas or the holding tool pressurized gas to the holding tool.

In an embodiment, the valve(s) may be (a) solenoid activated valve(s).

In an embodiment, the components of the bottom hole assembly may be positioned from uphole to downhole in the following sequence; the holding tool, the propellant with the igniter for igniting the propellant, the pressure chamber, the gas-driven rotatable motor and the cutting head including cutters.

In an embodiment, the propellant and the igniter for igniting the propellant may be an integrated component of the pressure chamber positioned above the gas-driven rotatable motor.

The holding tool set-point pressure, the gas-driven motor set-point pressure, the cutter set-point pressure and the piston set-point pressure are pressure thresholds for an action to start, stop or begin the process of stopping. By the combustion of the propellant, when the pressurized gas in the pressure chamber reaches these thresholds, i.e. set-point pressure, the corresponding actions are initiated. As the pressurized gas in the pressure chamber is spent, the pressure in the pressure chamber will decrease below the set-point pressures, thereby stopping or beginning the process of stopping the actions. When the pressure in the pressure chamber exceeds any of the set-point pressures to initiate an action, it will have had to overcome the wellbore pressure and the force of any of the retraction or biasing mechanisms.

It is further described a method of cutting a downhole pipe using a bottom hole assembly as defined above, the method comprising the following steps in sequence:

prior to deployment, selecting an amount of propellant based on in situ wellbore pressure and mass of tubular to be cut;

deploying the bottom hole assembly at a given depth within the pipe;

activating and setting the holding tool for securing the bottom hole assembly within the pipe;

igniting the propellant using the igniter and thereby developing a pressurized gas in the pressure chamber;

activating the gas-driven rotatable motor by providing the pressurized gas from the pressure chamber to the gas-driven rotatable motor and exhausting the pressurized gas from the gas-driven rotatable motor to an exterior of the bottom hole assembly, thereby rotating the gas-driven rotatable motor and the mechanical cutting head when the pressure in the pressure chamber is at or above a motor set-point pressure;

cutting the pipe mechanically by rotation of the gas-driven rotatable motor and the mechanical cutting head;

deactivating the rotation of the gas-driven rotatable motor and thereby the mechanical cutting head when the pressurized gas decreases to a pressure below the motor set-point pressure due to exhausting the pressurized gas from the gas-driven rotatable motor to the exterior of the of the bottom hole assembly;

deactivating the holding tool;

pulling out the bottom hole assembly from the borehole.

In an embodiment, the igniting step occurs prior to the step of activating and setting the holding tool, the method further comprising: utilizing the gas from the pressure chamber for activating and setting the holding tool when the pressurized gas in the pressure chamber is at or above a holding tool set-point pressure, and wherein deactivating the holding tool occurs when the pressure in the pressure chamber is below the holding tool set-point pressure.

In an embodiment, a method of cutting a downhole pipe comprises: prior to deployment selecting an amount of propellant based on in situ wellbore pressure and mass of tubular to be cut; deploying the bottom hole assembly as described within a borehole;

positioning the bottom hole assembly at, near or within a desired tubular section; igniting the propellant using the igniter and thereby developing a pressurized gas in the pressure chamber; activating and setting the holding tool for securing the bottom hole assembly within the tubular by providing the pressurized gas from the pressure chamber to the holding tool; activating the gas-driven rotatable motor by providing the pressurized gas from the pressure chamber to the gas-driven rotatable motor and exhausting the pressurized gas from the gas-driven rotatable motor to an exterior of the bottom hole assembly, and thereby rotating the gas-driven rotatable motor and the mechanical cutting head when the pressure in the pressure chamber is at or above a motor set-point pressure;

cutting the pipe mechanically by rotating the gas-driven rotatable motor and the mechanical cutting head; deactivating the rotation of the gas-driven rotatable motor and thereby the mechanical cutting head when the pressurized gas decreases to a pressure below the motor set-point pressure due to exhausting the pressurized gas from the gas-driven rotatable motor to the exterior of the bottom hole assembly; deactivating the holding tool when the pressure in the pressure chamber declines below the holding tool set-point pressure; pulling out the bottom hole assembly from the borehole.

In an embodiment, a method of cutting a downhole pipe comprises: prior to deployment selecting an amount of propellant based on in situ wellbore pressure and mass of tubular to be cut; deploying a bottom hole assembly as described within a borehole, wherein the bottom hole assembly further comprises a holding tool pressure chamber, a holding tool propellant and an igniter for igniting the holding tool propellant; the method comprises the steps of:

positioning the bottom hole assembly at, near or within a desired tubular section;

igniting the holding tool propellant to develop a holding tool pressurized gas inside the holding tool pressure chamber;

utilizing the gas from the holding tool pressure chamber for activating and setting the holding tool when the holding tool pressurized gas in the holding tool pressure chamber is at or above a holding tool set-point pressure;

igniting the propellant using the igniter and thereby developing a pressurized gas in the pressure chamber; activating the gas-driven rotatable motor by providing the pressurized gas from the pressure chamber to the gas-driven rotatable motor and exhausting the pressurized gas from the gas-driven rotatable motor to an exterior of the bottom hole assembly, and thereby rotating the gas-driven rotatable motor and the mechanical cutting head when the pressure in the pressure chamber is at or above a motor set-point pressure;

cutting the pipe mechanically by rotating the gas-driven rotatable motor and the mechanical cutting head;

deactivating the rotation of the gas-driven rotatable motor and thereby the mechanical cutting head when the pressurized gas declines to a pressure below the motor set-point pressure due to exhausting the pressurized gas from the gas-driven rotatable motor to the exterior of the bottom hole assembly;

deactivating the holding tool when the pressure in the holding tool pressure chamber is below the holding tool set-point pressure;

pulling out the bottom hole assembly from the borehole.

In an embodiment, the method further comprises reducing the pressure in the holding tool pressure chamber below the holding tool set-point pressure by an upward pull on the bottom hole assembly exercised by the operator at surface via the deployment system.

In an embodiment, the method further comprises utilizing a locating tool to locate the desired tubular section within the borehole.

In an embodiment, the method further comprises the steps of: closing a valve to stop the flow of gas to the gas-driven rotatable motor; repositioning the bottom hole assembly to a second position within the tubular section; opening the valve to deliver gas to the gas-driven rotatable motor; rotating the cutting head coupled thereto, thereby producing a second cut in the tubular.

In an embodiment, the method further comprises the steps of: closing a valve to stop the flow of gas to the gas-driven rotatable motor and the holding tool; repositioning the bottom hole assembly to a second position within the tubular section; opening the valve to deliver gas to the gas-driven rotatable motor and the holding tool; rotating the cutting head coupled thereto, thereby cutting a second cut in the tubular.

In an embodiment, the method further comprises the steps of: closing a first valve to stop the flow of gas to the gas-driven rotatable motor; closing a second valve to stop the pressurized gas or the holding tool pressurized gas from reaching the holding tool and thereby allowing deactivation of the holding tool; repositioning the bottom hole assembly to a second position within the tubular section; opening a second valve to supply the pressurized gas or the holding tool pressurized gas to activate and set the holding tool; opening a first the valve to deliver gas to the gas-driven rotatable motor; rotating the cutting head coupled thereto, thereby cutting a second cut in the tubular.

If the cutting tool is deployed by a method with no communication with surface, one or more timers may be used to activate the cutting tool. A timer is a clock set to start a process after specified period. One or more timers may be used to activate the functions of the bottom hole assembly. When the one or more timers reach their set time, designated actions of the bottom hole assembly may then be activated. The timer will trigger power to activate one or more ignitors to initiate the propellant combustion process. In the situation where embodiments of the cutting tool employ valves to let pressurized gas escape the one or more pressure chambers, the timer will trigger power to activate the one or more valves to open and/or close.

Multiple cutting tools may be used in a bottom hole assembly to sever the tubular at multiple locations. Depending on the length of each cutting tool, there will be a limited number of cutting tools which may be accommodated into the constrained length of the bottom hole assembly which is normally limited by the rig up height at surface.

Alternatively, when the process of releasing pressurized gas from the pressure chamber is controlled by one or more valves, these valves may be selectively controlled to release and stop the release of pressurized gas to facilitate multiple cuts within a tubular.

The cutting tool may further include a control module comprising a controller in electronic communication with the one or more igniters and, when any valves are in place, the one or more valves.

The one or more igniters and, when relevant, the one or more valves, may be configured to receive electrical power from surface through a wireline cable/E-line.

The bottom hole assembly or the cutting tool may comprise one or more batteries, where the one or more igniters and, when relevant, the valves are configured to receive electrical power from the one or more batteries.

When deployed by a method having the option of electrical or fibre optic communication, a computing system may be located at the surface to provide a user-interface for monitoring and controlling the downhole operation of the cutting tool.

When the cutting tool is deployed by a method with an electrical or fibre optic cable in communication with surface, the activation of the cutting tool may be triggered or initiated by an operator at surface.

Statements made herein referring to a component being "above", "below", "uphole" or "downhole" relative to another component, should be interpreted as if the downhole tool or bottom hole assembly has been run into a wellbore. It should be noted that even a horizontal wellbore, or any non-vertical wellbore, still has an "uphole" direction defined by the path of the wellbore that leads to the surface and a "downhole" direction that is generally opposite to the "uphole" direction. Tubular, tubing, and pipe; referring to a well component found inside subterranean well boreholes may be used interchangeably. Reference to a fluid or fluids herein, shall not limit the scope of the fluid to a gas, a liquid or combination of a gas and a liquid. Rather, the use of "fluid" may be replaced with "gas", "liquid" or a "combination of gas and liquid" without altering or limiting the scope of the disclosures herein. Moreover, it should be noted that a gas, a liquid or a combination of a gas and liquid; are all in fact, fluids.

BRIEF DESCRIPTION OF THE DRAWINGS

Following drawings are appended to facilitate the understanding of the invention. The drawings show embodiments of the invention, which will now be described by way of example only, where:

FIG. 13A is a view of a cutting tool including a valve comprising a valve plate, valve plate cover, valve actuator and a fluid communication through passage.

FIG. 13B is a cross-section view of the cutting tool of FIG. 13A about line G-G.

FIG. 15A is a view of a cutting tool including two valves and two pressure chambers.

FIG. 15B is a cross-section view of the cutting tool of FIG. 15A about line H-H.

FIG. 16A is a view of a cutting tool including a cutter actuation fluid passage.

FIG. 16B is a cross-section view of the cutting tool of FIG. 17A about line J-J.

FIG. 19A is a bottom hole assembly including a holding tool.

FIG. 19B is a cross-section of FIG. 19A along line L-L.

DETAILED DESCRIPTION OF PREFERENTIAL EMBODIMENTS

Figure 1:
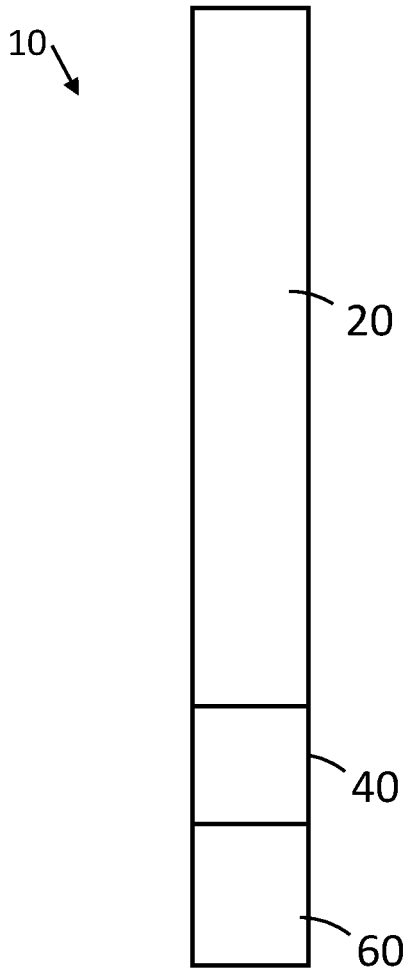
FIG. 1 shows schematic of a cutting tool.

FIG. 1 shows a schematic of a cutting tool 10, including a pressure chamber 20, a gas-driven rotatable motor 40, and a cutting head 60. The cutting tool 10 may be used in a subterranean well 4 as shown in FIG. 2.

Figure 2:
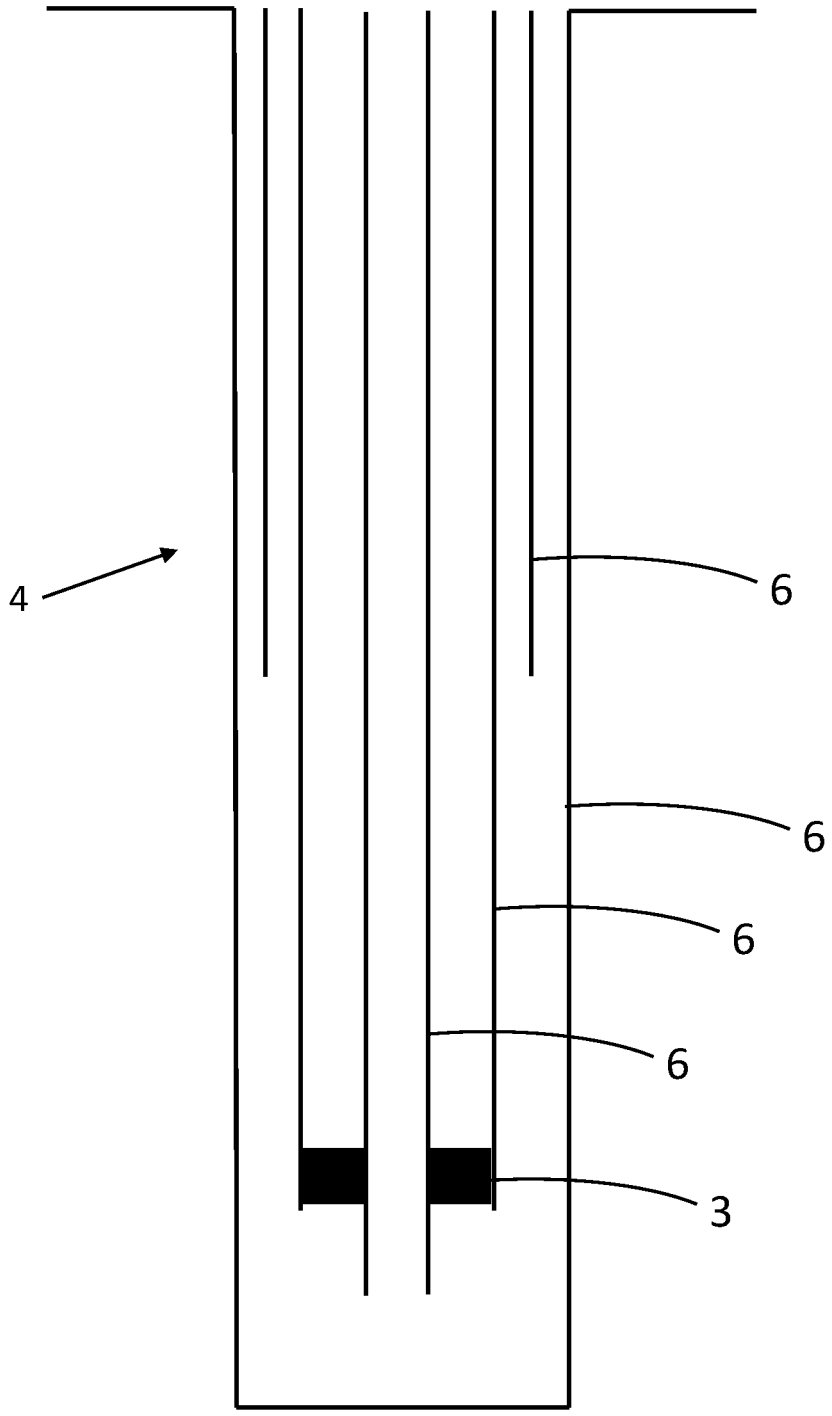
FIG. 2 shows a cross-sectional schematic of a subterranean well.

FIG. 2 is showing a cross-section schematic of a subterranean well 4 with several tubulars/pipes 6, where the inner tubular 6 is equipped with a packer 3.

Figure 3:
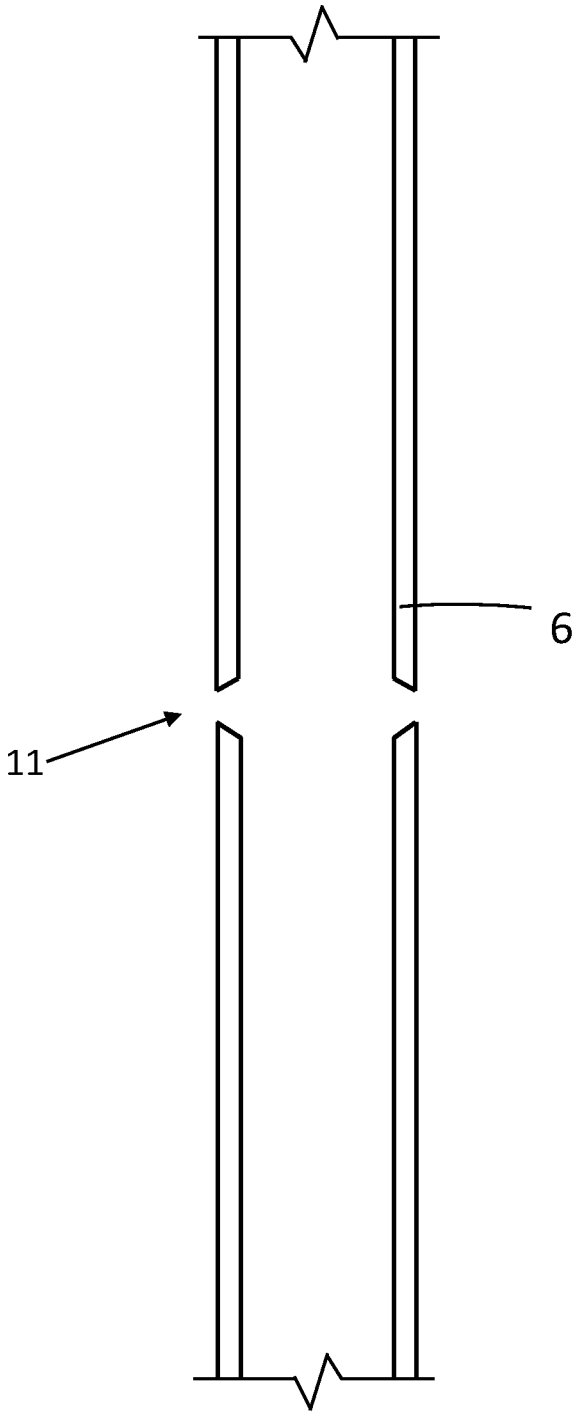
FIG. 3 shows a severed tubular.

FIG. 3 is showing a schematic of the preferred result from use of the cutting tool 10, a tubular 6 with a cut 11 therethrough.

Figure 4:
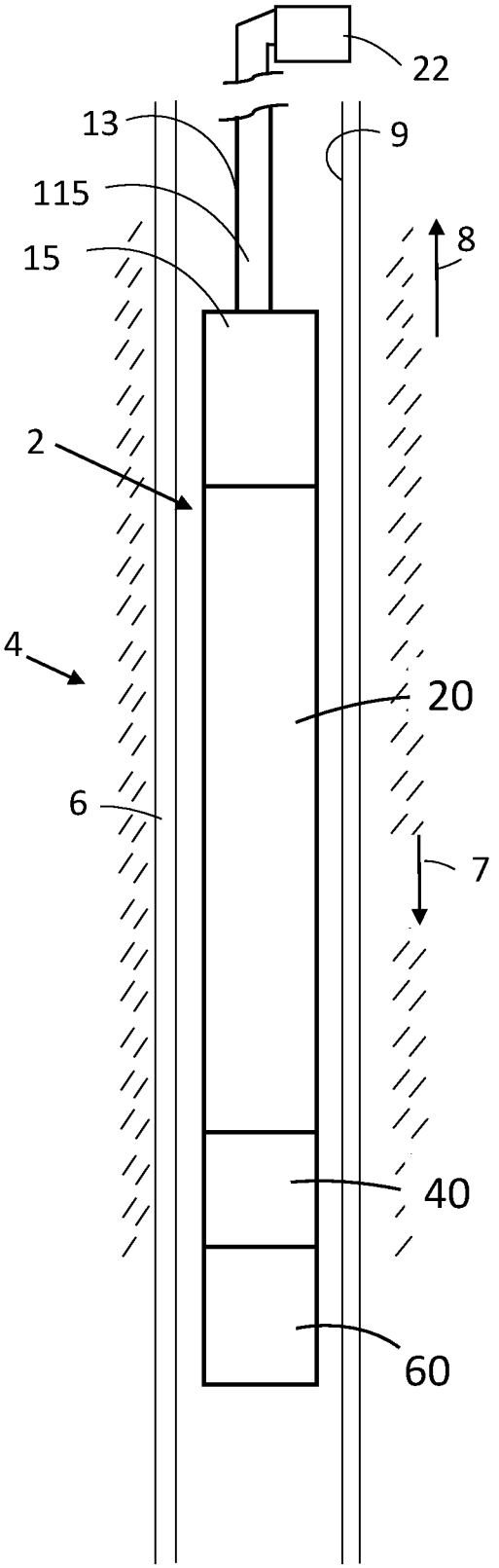
FIG. 4 shows a bottom hole assembly within a subterranean well deployed by a fluid pipe.

FIG. 4 is a schematic of a bottom hole assembly 2 deployed by a fluid pipe 13 in a subterranean well 4 having a tubular 6 with an inner surface 9 and an uphole direction 8 and a downhole direction 7. The bottom hole assembly 2 is connected to surface and thereby deployed by a fluid pipe 13 through which the pressurized fluid 115 generated at surface may be supplied to the pressure chamber 20 of the cutting tool/bottom hole assembly. The fluid pipe 13 is connected at top connector 15 of the bottom hole assembly 2, which also includes the pressure chamber 20, a gas-driven rotatable motor 40, and a cutting head 60. A surface system 22 is located at surface.

Figure 5A:
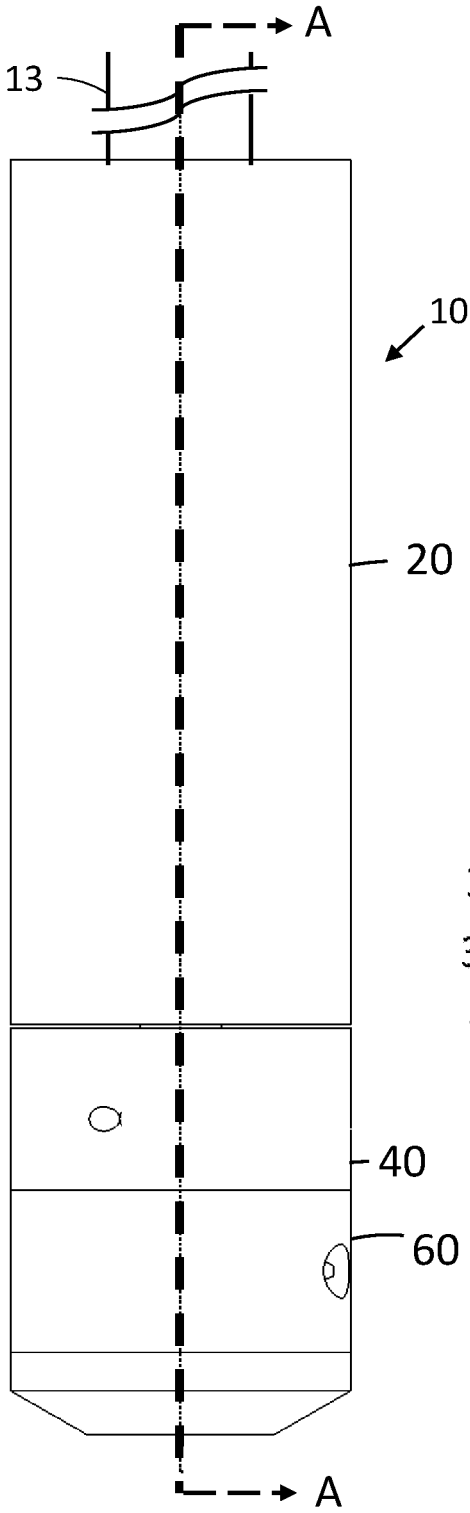
FIG. 5A is a view of a cutting tool.

FIG. 5A is showing a view of a cutting tool 10 connected to surface and thereby deployed by a fluid pipe 13; and includes a pressure chamber 20, a gas-driven rotatable motor 40, and a cutting head 60.

Figure 5B:
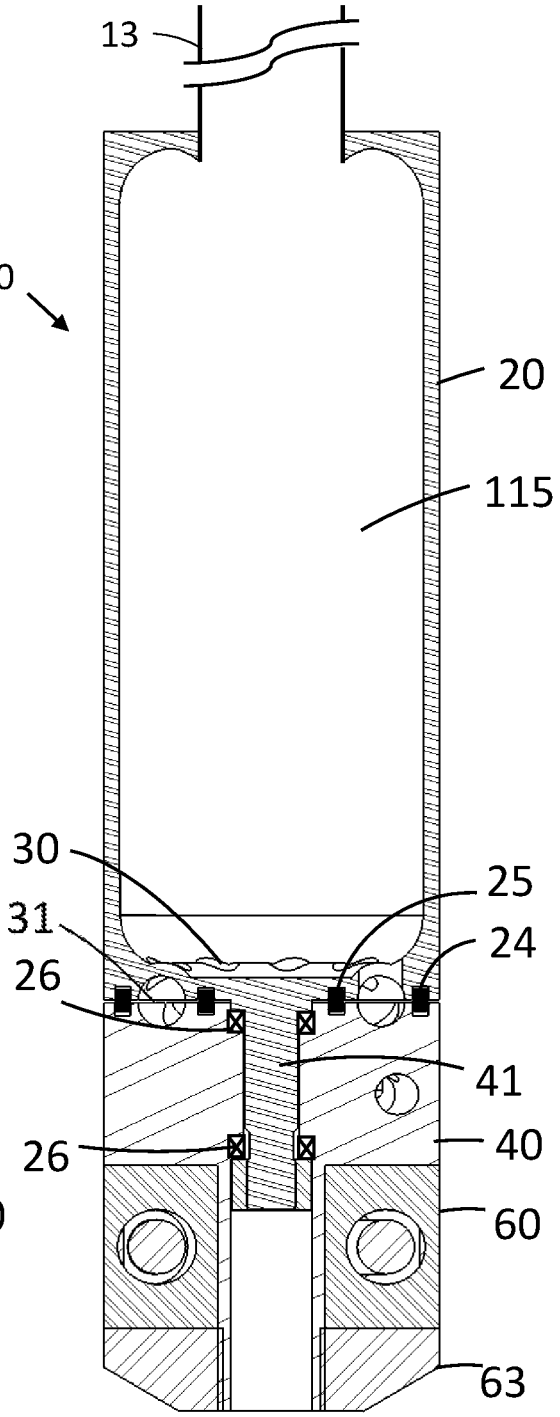
FIG. 5B is a cross-section view of the cutting tool of FIG. 5A, about line A-A.

FIG. 5B is a cross-section view of the cutting tool 10 of FIG. 5A about line A-A. The pressure chamber 20 is in fluid communication with the fluid pipe 13 and thereby may receive the pressurized fluid 115. The pressure chamber 20 includes one or more fluid passage ports 30 at a lower end of the pressure chamber 20 and a toroidal fluid passage 31 connected thereto, which provides fluid communication to the gas-driven rotatable motor 40. An outer rotary seal 24 is disposed on the outside of the toroidal fluid passage 31 and an inner rotary seal 25 is disposed on the inside of the toroidal fluid passage 31, each functioning to maintain fluid communication from the pressure chamber 20 to the gas-driven rotatable motor 40. The gas-driven rotatable motor 40 rotates about an extended portion of the pressure chamber 20, e.g. a gas-driven rotatable motor shaft 41. The gas-driven rotatable motor 40 and the cutting head 60 rotate about the gas-driven rotatable motor shaft 41 on bearings 26. A bottom nut 63 retains the cutting head 60 to the gas-driven rotatable motor 40.

Figure 6:
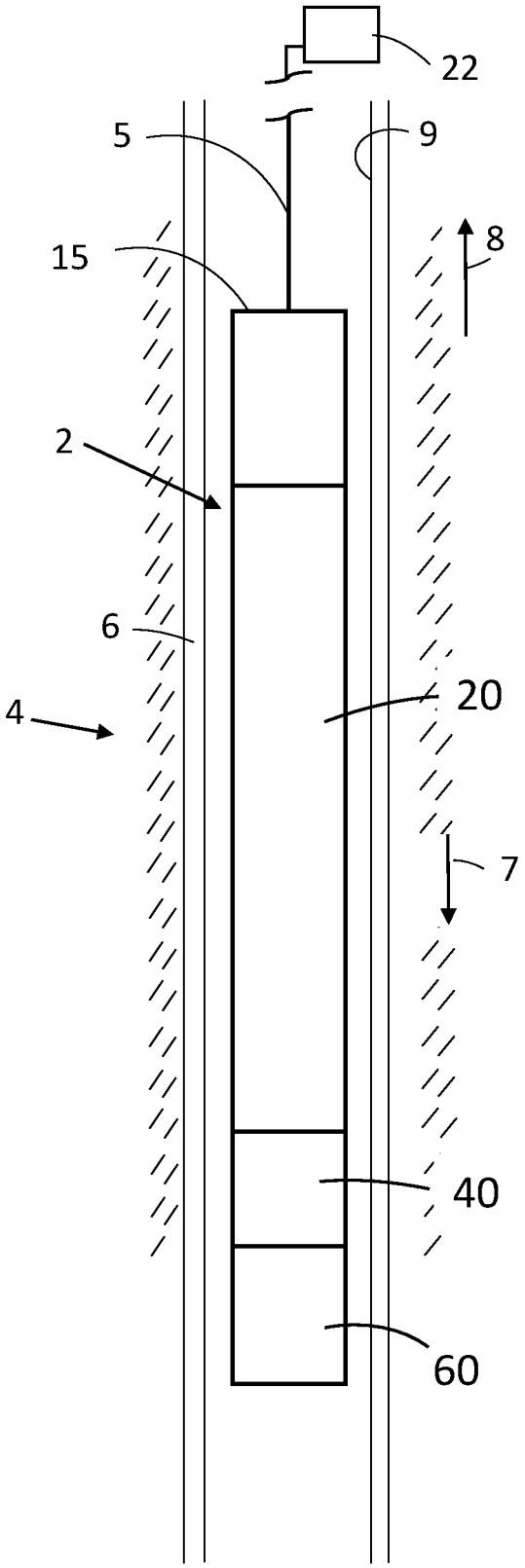
FIG. 6 shows a bottom hole assembly within a subterranean well deployed by a wireline.

FIG. 6 is showing a schematic of a bottom hole assembly 2 deployed in a subterranean well 4 having a tubular 6 with an inner surface 9 and an uphole direction 8 and a downhole direction 7. The bottom hole assembly 2 is connected to surface and deployed by a wireline 5 connected at a top connector 15 and includes a pressure chamber 20, a gas-driven rotatable motor 40, and a cutting head 60. A surface system 22 is located at surface and in communication with the bottom hole assembly 2 via the wireline 5.

Figure 7A:
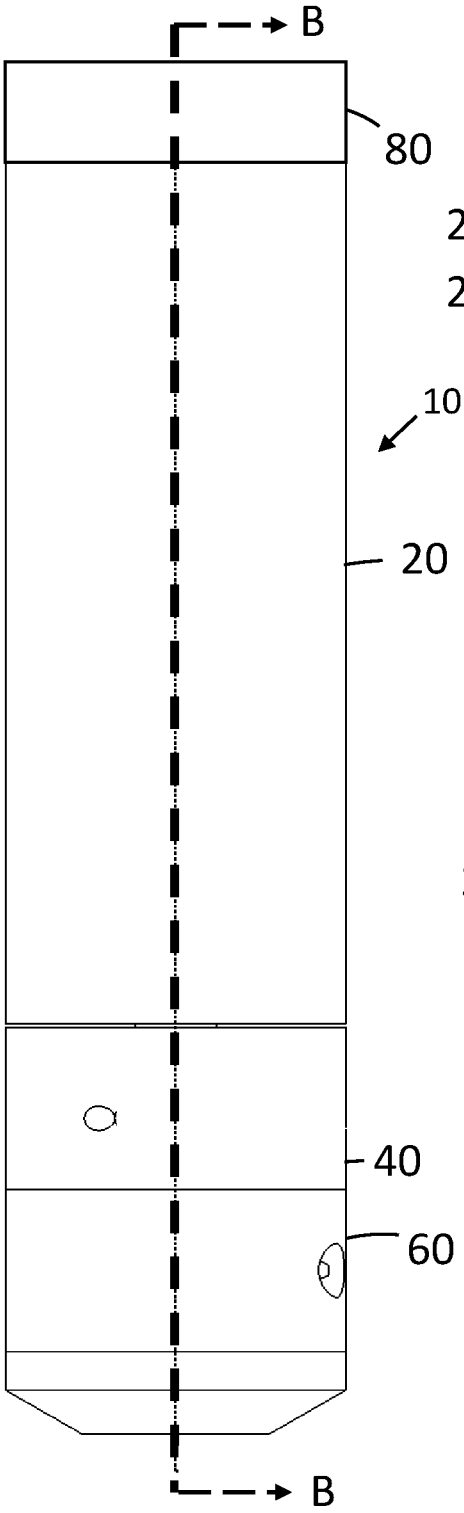
FIG. 7A is a view of a cutting tool including a propellant.

FIG. 7A is showing a view of a cutting tool 10 including a control module 80, a pressure chamber 20, a gas-driven rotatable motor 40 and a cutting head 60.

Figure 7B:
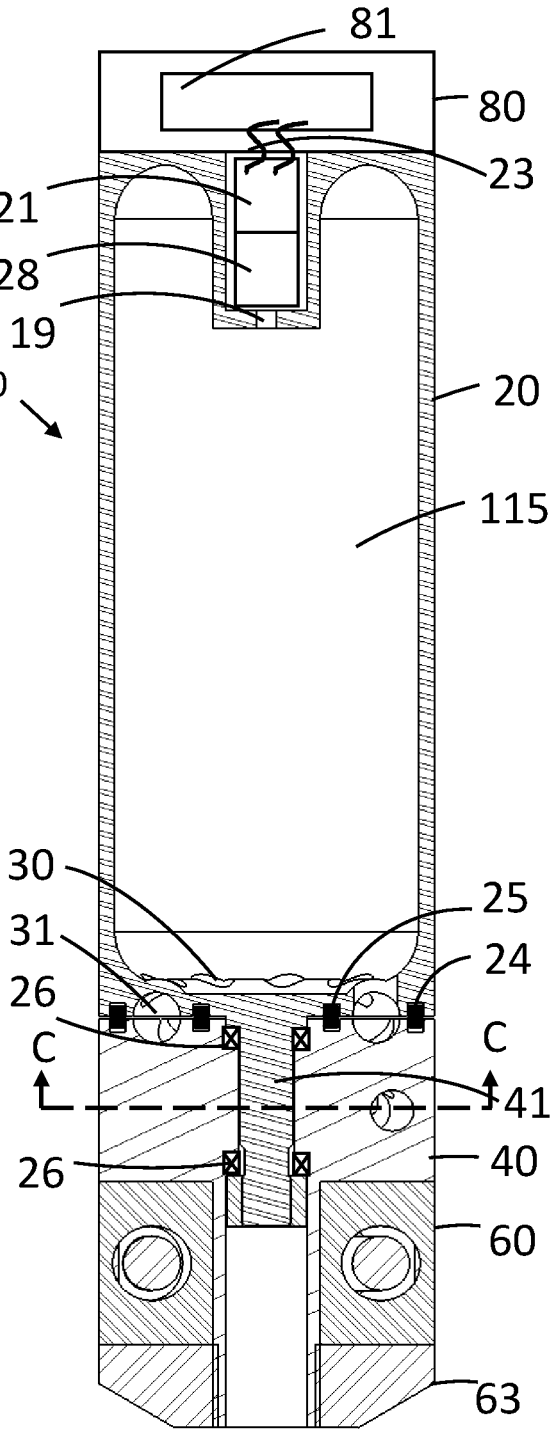
FIG. 7B is a cross-section view of the cutting tool of FIG. 7A about line B-B.

FIG. 7B is a cross-section view of the cutting tool 10 and the control module 80 of FIG. 7A about line B-B. In FIG. 7B a propellant 28, which is in fluid communication with the pressure chamber 20 via propellant gas passage 19, is shown. The propellant 28 is connected to an ignitor 21 which is in electrical communication via control wires 23 to controller 81 which resides inside the control module 80. When the ignitor 21 is activated by the controller 81, the propellant 28 starts generating pressurized fluid 115. The pressure chamber 20, in which the pressurized fluid 115 is generated by the propellant 28, is in fluid communication with the gas-driven rotatable motor 40 via one or more fluid passage ports 30 at a lower end of the pressure chamber 20, a toroidal fluid passage 31 connected thereto provides fluid communication to the gas-driven rotatable motor 40. An outer rotary seal 24 is disposed on the outside of the toroidal fluid passage 31 and an inner rotary seal 25 is disposed on the inside of the toroidal fluid passage 31, each functioning to maintain fluid communication from the pressure chamber 20 to the gas-driven rotatable motor 40, as the gas-driven rotatable motor 40 rotates about an extended portion of the pressure chamber 20, e.g. around a gas-driven rotatable motor shaft 41. The gas-driven rotatable motor 40 and the cutting head 60 rotate about the gas-driven rotatable motor shaft 41 on bearings 26. A bottom nut 63 retains the cutting head 60 to the fluid-powered motor 40.

Figure 8:
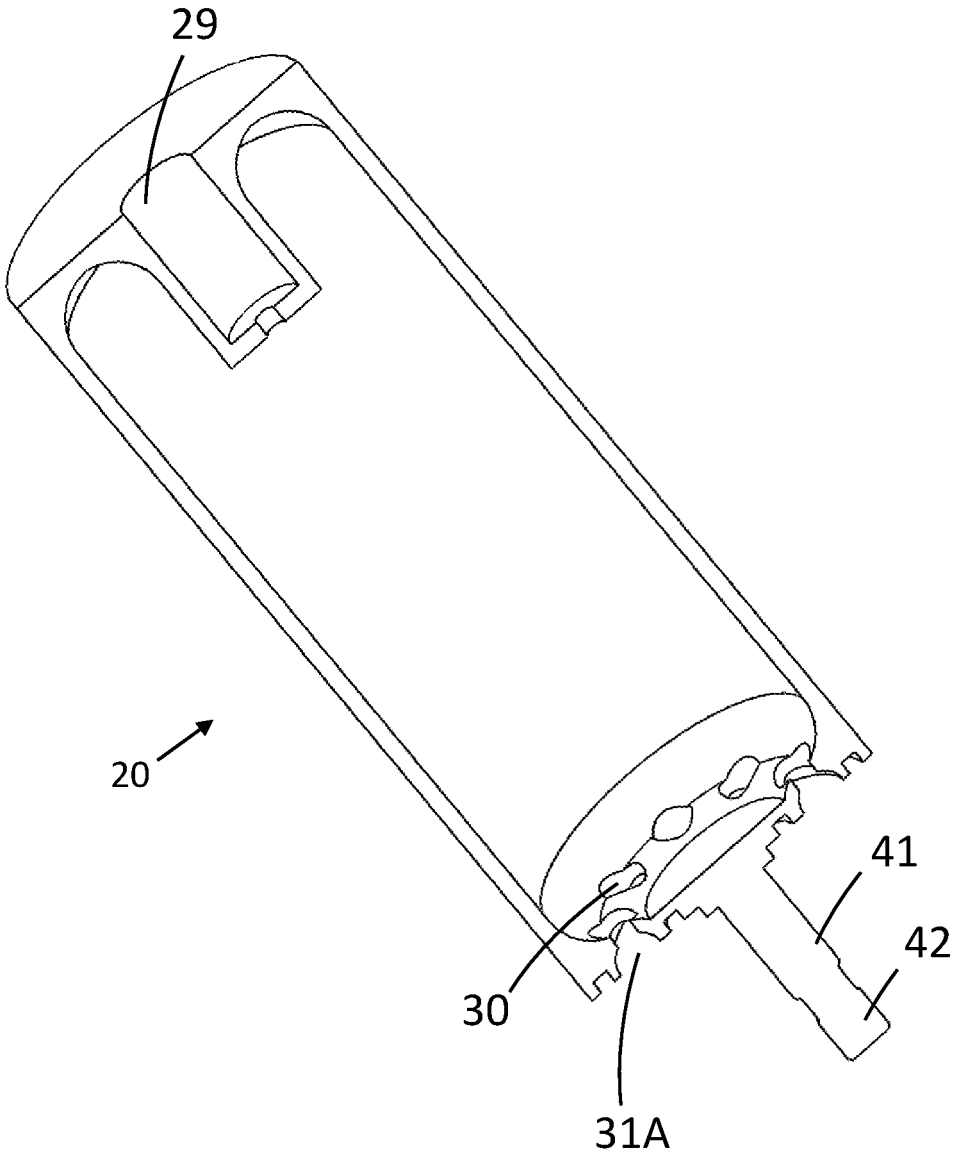
FIG. 8 is a cross-section of a cutting tool component, a pressure chamber.

FIG. 8 is showing a cutting tool 10 component, a pressure chamber 20, which includes a propellant holder 29 and the gas-driven rotatable motor shaft 41 with a gas-driven rotatable motor shaft threaded end 42. The pressure chamber 20 additionally includes one or more fluid passage ports 30 and half the toroidal fluid passage, 31A.

Figure 9A:
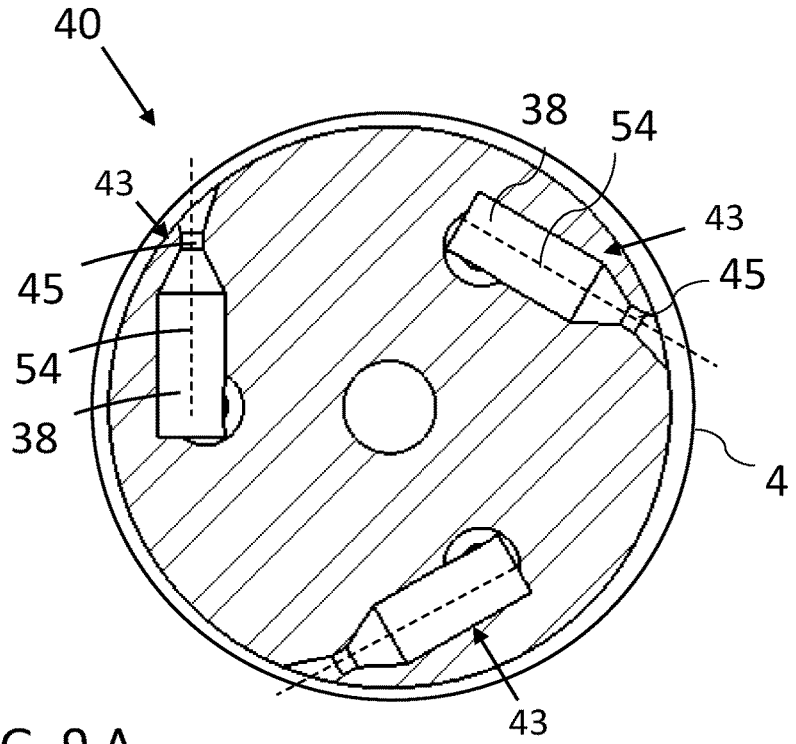
FIG. 9A is cross-section of a cutting tool component, a gas-driven rotatable motor, about line C-C of FIG. 7B.

FIG. 9A is showing a cross-section of a cutting tool component, i.e. a gas-driven rotatable motor 40, about line C-C of FIG. 7B. The gas-driven rotatable motor 40 includes fluid passages 43 each comprising a first portion 37 (see FIG. 9B) and a second portion 38. Each first portion 37 may be in fluid communication with a fluid source in the form of a pressurized fluid 115, when the gas-driven rotatable motor is disposed within the cutting tool. The second portions 38 of each fluid passage 43 may be in fluid communication with a fluid exterior the circumferential envelope of the cutting tool (i.e. exterior to the bottom hole assembly). The centre axis 54 of the second portions 38 of the fluid passages 43 are spaced apart relative to the other second portions of the fluid passages 43; the centre axis 54 of the second portions 38 of the fluid passages 43 and the longitudinal axis 48 of the gas-driven rotatable motor are skew lines. The fluid passages 43 are disposed to receive pressurized fluid 115 from the pressure chamber 20 and by the generation of thrust created from exhausting pressurized fluid 115 from the fluid passages 43 and nozzles 45 (i.e. jetting), rotate about the long axis of the cutting tool 10. This setup renders possible rotation of the cutting head 60 by exhausting pressurized fluid out through the fluid passages 43 because the fluid passages 43 are arranged at an angle different from 90 degrees (i.e. non-radial direction) relative a borehole wall encircling the bottom hole assembly in the well 4. To generate thrust of the cutting tool 10 relative the borehole wall, the fluid passages should probably be as tangential as possible to the radius of the bottom hole assembly, for example oriented as indicated in FIG. 9A.

Figure 9B:
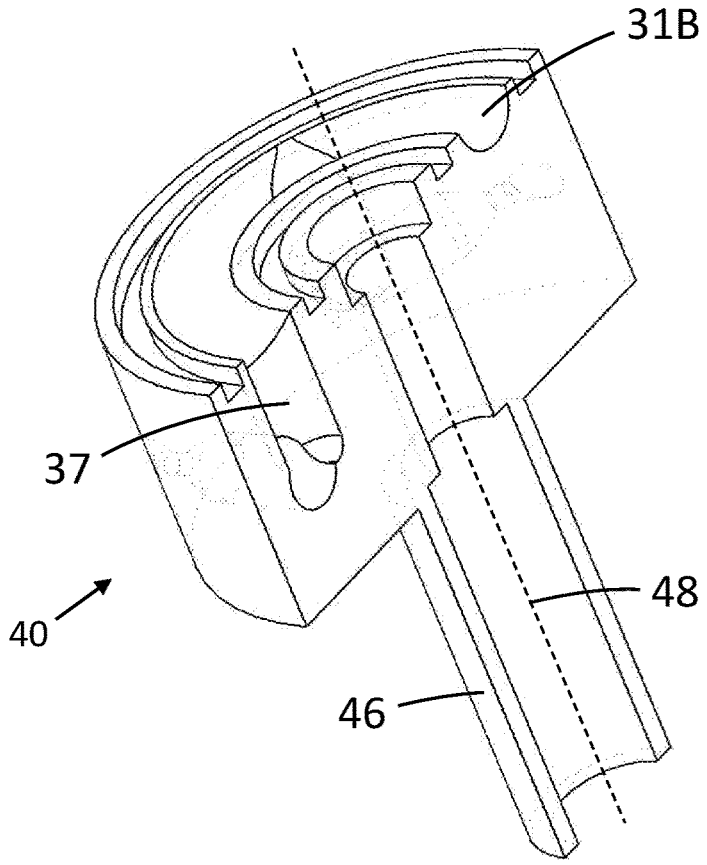
FIG. 9B is an isometric cross-section at 90 degrees of the gas-driven rotatable motor in FIG. 9A.

FIG. 9B is showing a cross-section 90 degrees of the gas-driven rotatable motor 40 in FIG. 9A, where the gas-driven rotatable motor 40 comprises one or more fluid passages 43 in fluid communication with a second half 31B of the toroidal fluid passage 31. The gas-driven rotatable motor 40, further includes a lowered extended portion, a cutting head shaft 46 on which the cutting head 60 is mounted and secured by a bottom nut 63.

Figure 10A:
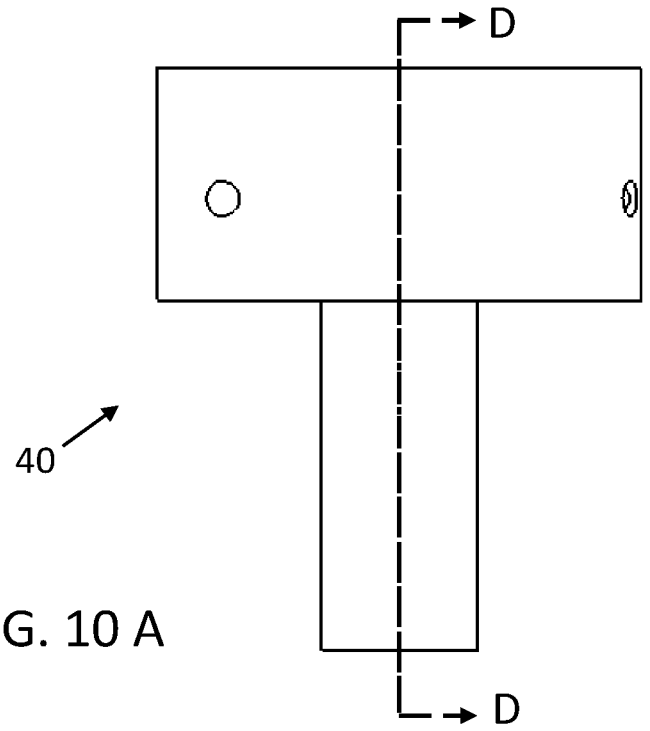
FIG. 10A is a side view of the gas-driven rotatable motor.

FIG. 10A is showing an alternate view of the gas-driven rotatable motor 40.

Figure 10B:
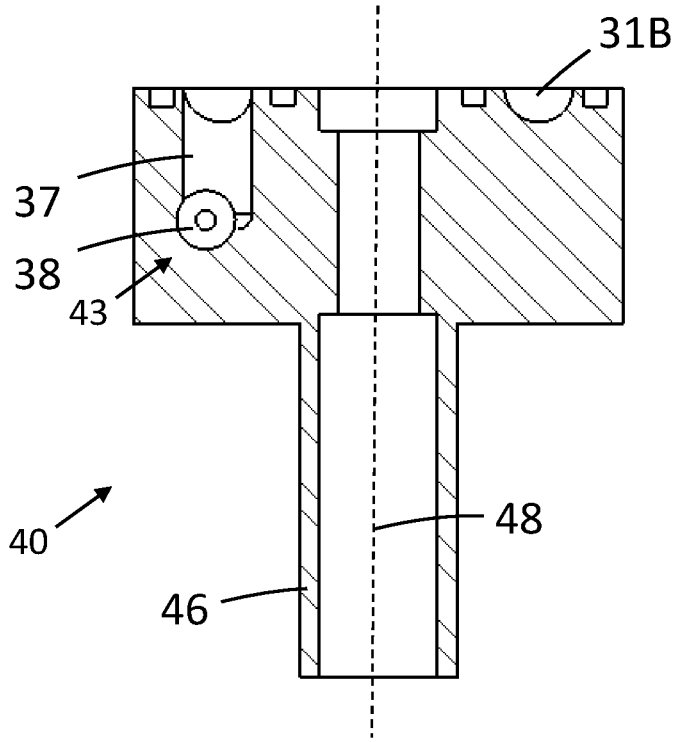
FIG. 10B is a cross-section of FIG. 10A about line D-D.

FIG. 10B is a cross-section of FIG. 10A about line D-D in FIG. 10A further showing the one or more fluid passages 43 in fluid communication with a second half 31B of the toroidal fluid passage 31; and the cutting head shaft 46.

Figure 11A:
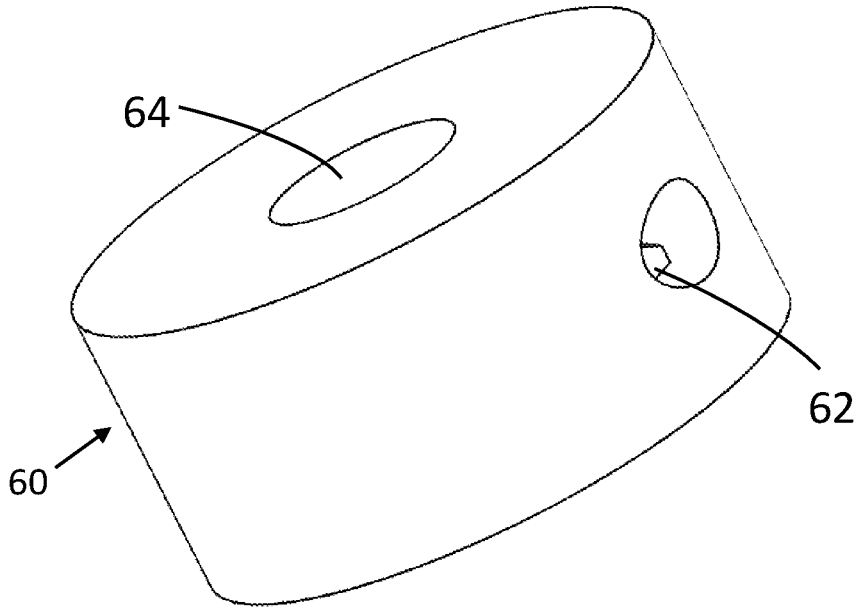
FIG. 11A is an example of cutting tool comprising a cutting head with cutters in the retracted position.

FIG. 11A is showing a cutting tool 10 component, a cutting head 60 with a through-hole 64 in which the cutting head shaft 46 (cutting head shaft 46 not shown in FIG. 11A, see e.g. FIG. 10B) is to be located. The cutters 62 are shown in the retracted position, i.e. in an initial position within a circumferential envelope of the cutting head.

Figure 11B:
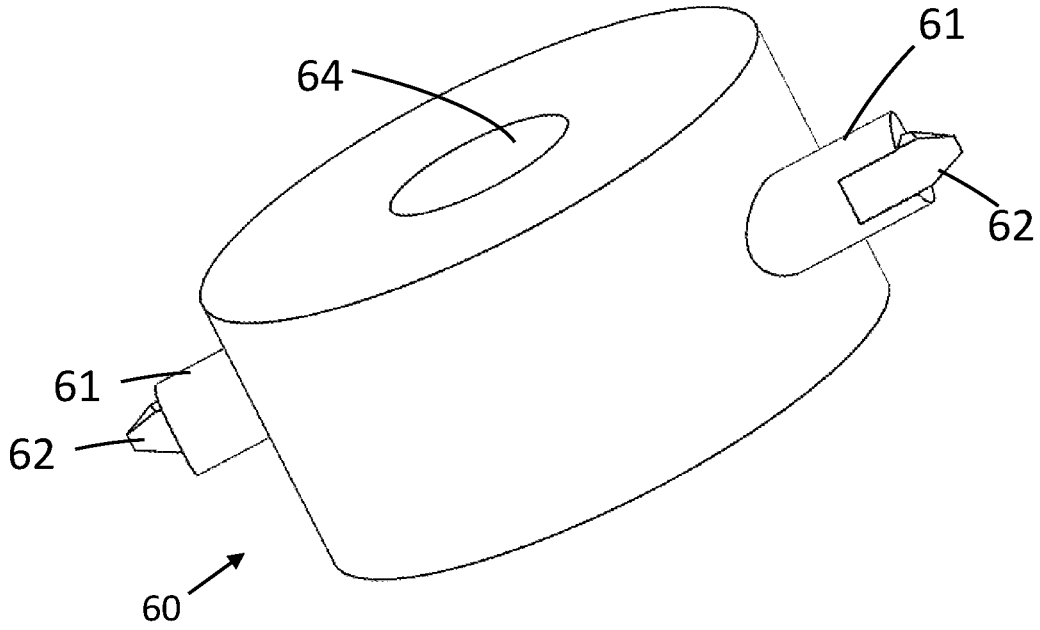
FIG. 11B is the cutting head with cutters in the extended position.

FIG. 11B is the cutting head 60 with cutters 62 in the extended position, i.e. outside a circumferential envelope of the cutting head, disposed at the end of cutter pistons 61. The cutting head 60 comprises one or more cutters 62, and the cutting head 60 is coupled to and disposed to receive rotational power and thereby centrifugal force from the gas-driven rotatable motor 40, thereby providing energy to extend the cutter pistons 61 and the cutters 62 to create a cut in a tubular 6 surrounding the cutting tool 10.

Figure 12A:
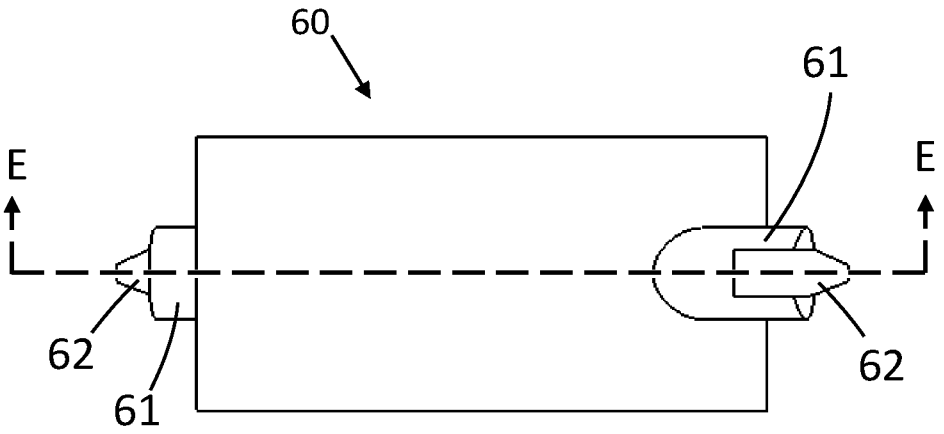
FIG. 12A is an alternate view of the cutting head with cutters in the extended position.

FIG. 12A is showing an alternative view of the cutting head 60 with cutters 62 in the extended position.

Figure 12B:
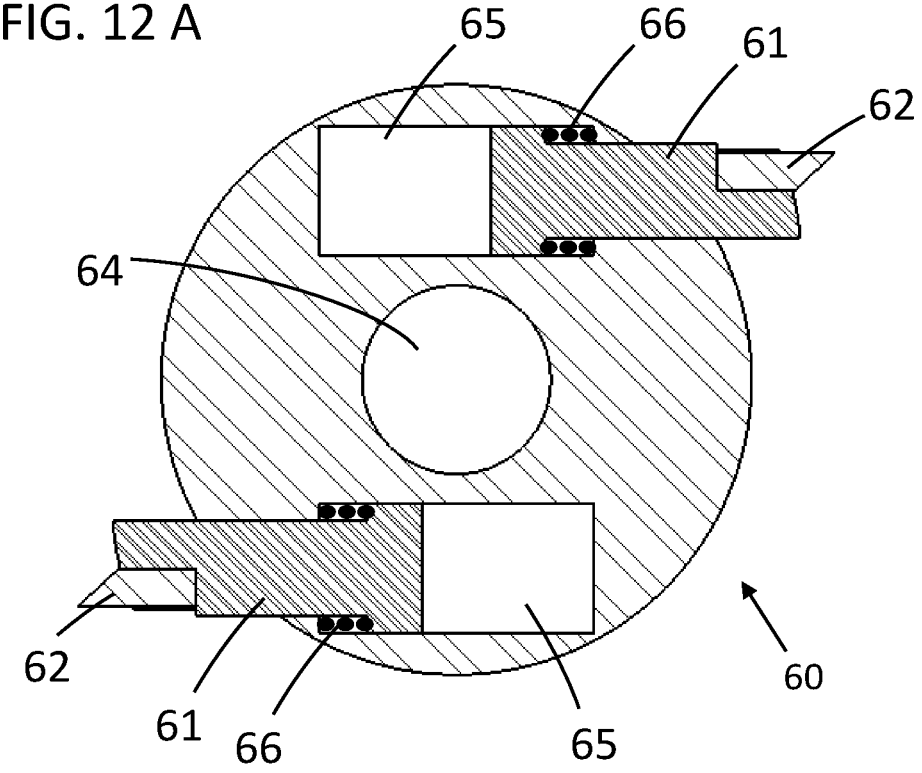
FIG. 12B is a cross-section of FIG. 12A about line E-E.

FIG. 12B is a cross-section of FIG. 12A about line E-E. The cutter pistons 61 with cutters 62 are extended from the cutter piston chamber 65 due to the rotation of the cutting head 60, i.e. by centrifugal force resulting from rotation of the cutting head. A piston return spring 66 resides on an opposing side of the cutter piston 61 such that when rotation of the cutting head 60 ceases, the pistons 61 may be returned to the retracted position, i.e. to the initial position within a circumferential envelope of the cutting head, by the force of springs 66. Also shown in FIG. 12B is the through-hole 64 in which the cutting head shaft 46 may be located.

FIG. 13A is showing a view of a cutting tool 10.

FIG. 13B is a cross-section view of the cutting tool 10 of FIG. 13A about line G-G. A valve plate 50 resides inside pressure chamber 20 and a valve actuator 52 may selectively actuate a valve plate cover 51 to open and close fluid communication through passage 53 in the valve plate 50. In this way, pressurized fluid 115 within the pressure chamber 20 may be selectively provided to the fluid-powered motor 40. The valve actuator 52 is in electrical communication with the controller 80 within the control module 81 via control wires 23. The arrangement shown in FIG. 13B thereby provides a method of creating a second cut in a tubular 6 at a different location. The method comprising the steps of: deploying the bottom hole assembly 2 on wireline 5; positioning the bottom hole assembly 2 within a tubular 6 segment such that the cutting tool 10 is in a desired position to cut the desired section of tubular 6; delivering fluid to the gas-driven rotatable motor 40; rotating the cutting head 60 coupled thereto; cutting the tubular 6; activating the valve actuator 52 thereby putting valve plate cover 51 in a position to stop the flow of pressurized fluid 115 to the gas-driven rotatable motor 40; repositioning the bottom hole assembly 2 to a second position within the tubular 6; retracting valve plate cover 51 and delivering pressurized fluid 115 to the gas-driven rotatable motor 40; rotating the cutting head 60 coupled thereto; cutting the second cut 11 in the tubular 6.

In one embodiment as shown in FIG. 13B, the valve 49 comprises a valve actuator 52 disposed to actuate a valve plate cover 51 to selectively provide fluid communication through valve plate 50 via a fluid communication through-passage 53 therethrough.

Figure 14:
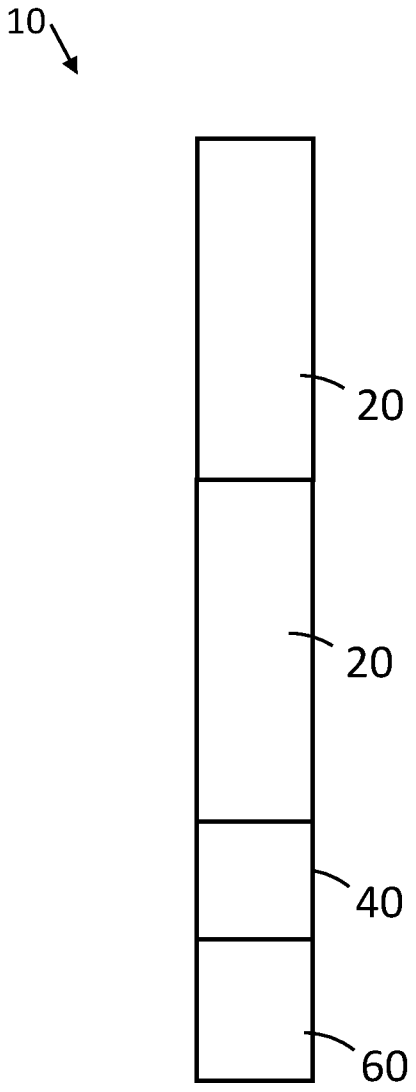
FIG. 14 shows schematic of a cutting tool, including two pressure chambers.

FIG. 14 shows a schematic of a cutting tool 10, including a cutting head 60, a fluid-powered motor 40 and two pressure chambers 20.

FIG. 15A is showing a view of a cutting tool 10 with two pressure chambers, i.e. a first and second pressure chamber 20A, 20B.

FIG. 15B is a cross-section view of the cutting tool 10 of FIG. 15A about line H-H. The cutting tool 10 includes a first pressure chamber 20A including a valve plate 50A with a fluid communication through-passage 53A therethrough and an associated valve plate cover 51A that may be selectively opened and closed by the actuation of valve actuator 52A. The cutting tool 10 further includes a second pressure chamber 20B including a valve plate 50B with a fluid communication through-passage 53B therethrough and an associated valve plate cover 51B that may be selectively opened and closed by the actuation of valve actuator 52B. Each valve actuator 52A and 52B are in electrical communication with the controller 81 in the control module 80 via control wires 23A and 23B, respectively. In this manner, pressurized fluid 115 in pressure chamber 20A may be provided to the gas-driven rotatable motor 40 independently from the provision of pressurized fluid 115 within pressure chamber 20B.

FIG. 16A is showing a view of a cutting tool 10.

FIG. 16B is a cross-section view of the cutting tool 10 of FIG. 16A about line J-J in FIG. 16A. The cutting tool 10 includes a cutter actuation fluid passage 47 which establishes fluid communication between the pressure chamber 20 and the cutter piston chambers 65.

Figure 17:
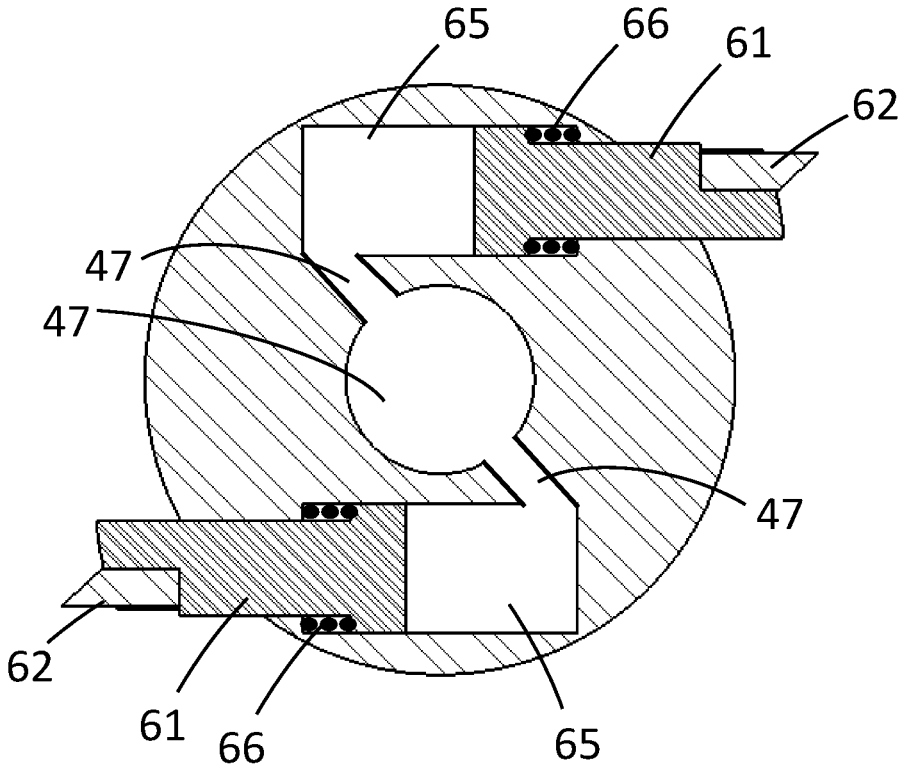
FIG. 17 is a cross-sectional view about line K-K of FIG. 16B.

FIG. 17 is a cross-sectional view about line K-K of FIG. 16B. Cutter actuation fluid passage 47 is shown in fluid communication with cutter piston chambers 65 such that when pressurized fluid 115 is delivered from the pressure chamber 20 to the piston chambers 65 via the cutter actuation fluid passage 47, the cutter pistons 61 with cutters 62 are extended. When pressure within piston chambers 65 is depressurized in one way or another when the cut 11 is completed, piston return springs 66 may return the cutter pistons 61 to the retracted position, i.e. to the initial position within a circumferential envelope of the cutting head 60.

Figure 18A:
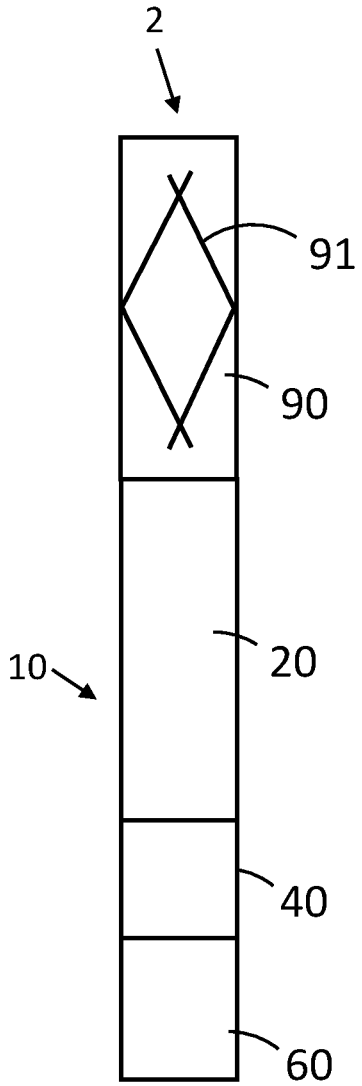
FIG. 18A is a schematic of a bottom hole assembly including a holding tool.

FIG. 18A is showing a schematic of a bottom hole assembly 2 including a cutting tool 10 and a holding tool 90 with holding linkages 91.

Figure 18B:
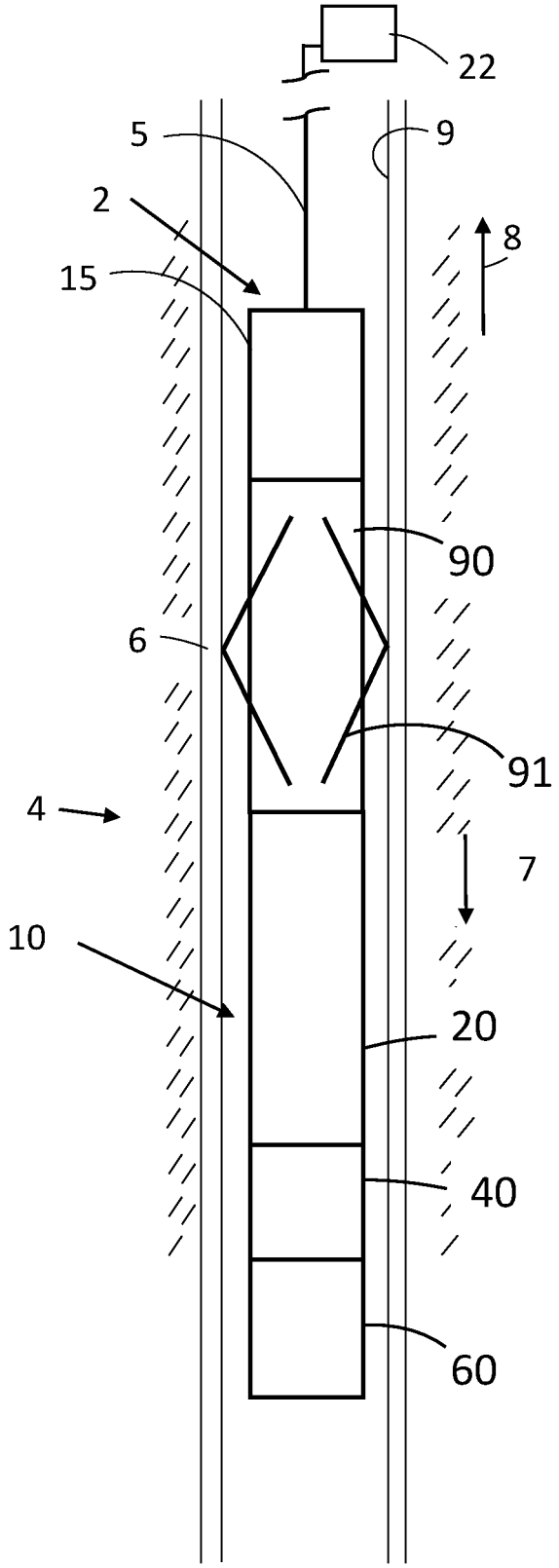
FIG. 18B shows FIG. 18A in a bottom hole assembly including a holding tool engaging the inner surface of a tubular within a subterranean well.

FIG. 18B shows the bottom hole assembly 2 of FIG. 18A deployed in a subterranean well 4 having a tubular 6 with an inner surface 9 and an uphole direction 8 and a downhole direction 7. The bottom hole assembly 2 is connected to surface by a wireline 5 at a top connector 15 and further includes a holding tool 90 with holding linkages 91 actuated to secure the bottom hole assembly 2 to the inner surface 9, a pressure chamber 20, a gas-driven rotatable motor 40 and a cutting head 60. Upon activation, the holding tool 90 engages the tubular 6 to the inner surface 9 of the tubular which is to be severed. In this manner, the wireline 5 is prevented from counter rotating during the cutting process, relative to the rotating components of the cutting tool 10, for example, the gas-driven rotatable motor 40 and the cutting head 60. The holding tool 90 additionally maintains the bottom hole assembly 2 at the desired longitudinal position within the subterranean well 4. A surface system 22 may be located at surface and in communication with the bottom hole assembly 2 via wireline 5.

FIG. 19A is showing a bottom hole assembly 2 including a cutting tool 10, holding tool 90 with holding linkages 91 and holding pads 92.

FIG. 19B is a cross-section of FIG. 19A along line L-L. Holding linkages 91 of the holding tool 90 are pinned at an uphole direction 8 of the holding tool 90. Additional holding linkages 91A are pinned to a holding tool actuation piston 94 at the downhole direction 7 of holding tool 90 with holding pads 92 connected therebetween. When pressurized fluid 115 within pressure chamber 20 is communicated through holding tool actuation passage 93 at a pressure sufficient to overcome the force of the holding tool return spring 95, holding tool actuation piston 94 is actuated in an uphole direction 8, thereby extending holding linkages 91 and 91A, and holding pads 92 radially thereby keeping the bottom hole assembly 2 in a fixed position versus the tubular 6 in a subterranean well 4. Thereby the pressurized fluid 115 in pressure chamber 20 may be used to actuate the holding tool 90 as described, and at the same time provide pressurized fluid 115 to the gas-driven rotatable motor 40.

Figure 20A:
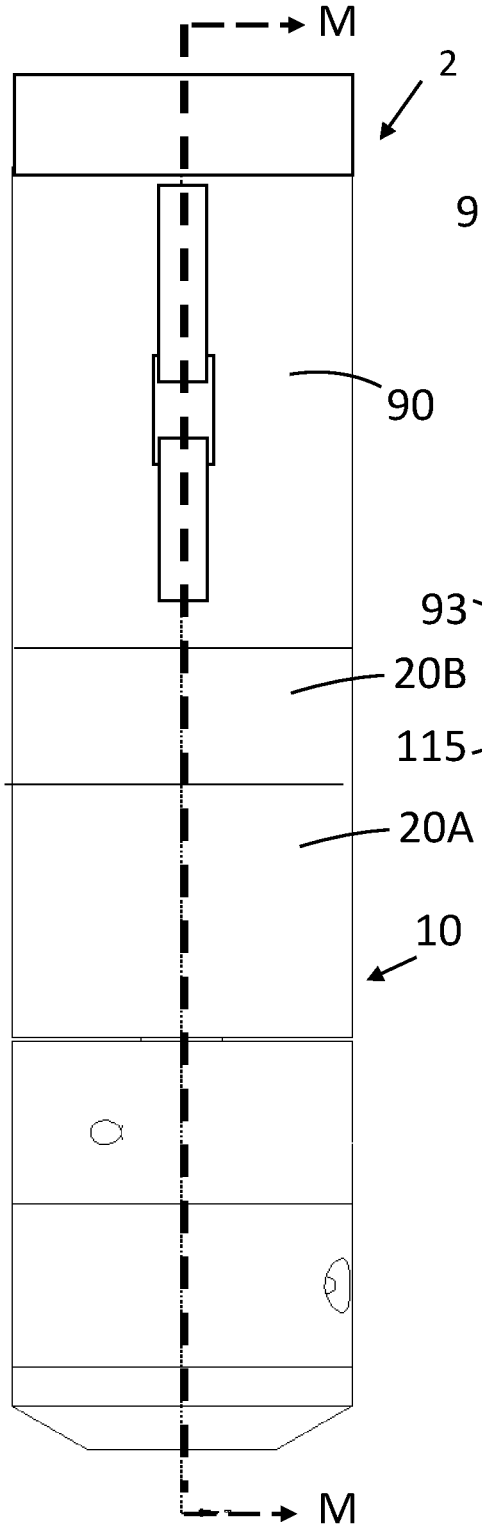
FIG. 20A is a bottom hole assembly including a holding tool and a second pressure chamber.

FIG. 20A is showing a bottom hole assembly 2 including a holding tool 90 and a cutting tool 10 which contains two pressure chambers 20A and 20B.

Figure 20B:
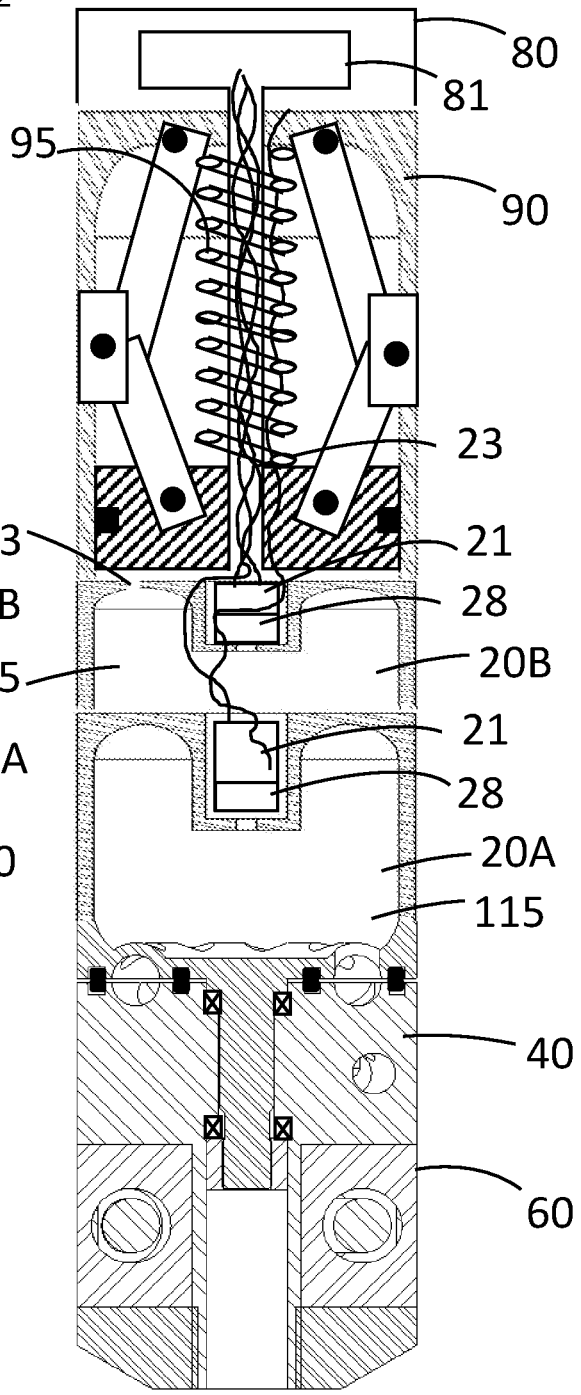
FIG. 20B is a cross-section of FIG. 20A along line M-M.

FIG. 20B is a cross-section of FIG. 20A along line M-M in FIG. 20A. Pressure chamber 20A is in fluid communication with the gas-driven rotatable motor 40 while pressure chamber 20B is in fluid communication with the holding tool 90. In this manner, pressurized fluid 115 and thereby fluid power, is provided to the fluid-powered motor 40 and the holding tool 90 which may be independently controlled. Each pressure chamber 20A and 20B is provided with pressurized fluid 115 by the activation of ignitor 21 which ignites propellant 28. The activation of propellant 28 is controlled by control wires 23 in electrical communication with the controller 81 in the control module 80. Normally, pressure chamber 20B will be activated first to activate the holding tool 90, then pressure chamber 20A will be activated to activate the gas-driven rotatable motor 40 which then again puts the cutting head 60 in a rotation.

Figure 21:
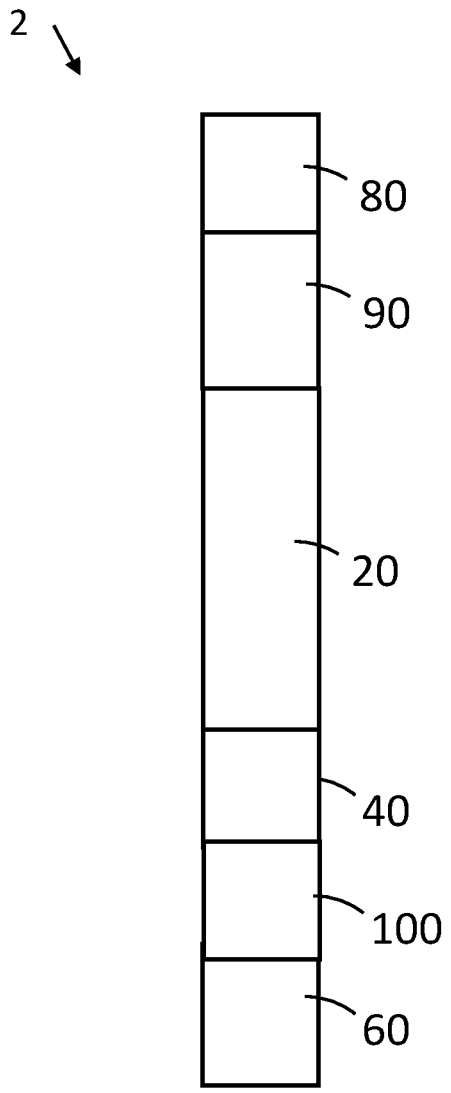
FIG. 21 shows a schematic of a bottom hole assembly with a cutting tool and a gearbox.

FIG. 21 is showing a schematic of a bottom hole assembly 2 including from top to bottom; a control module 80, a holding tool 90, a pressure chamber 20, a fluid-powered motor 40, a gearbox 100 and a cutting head 60.

Figure 22A:
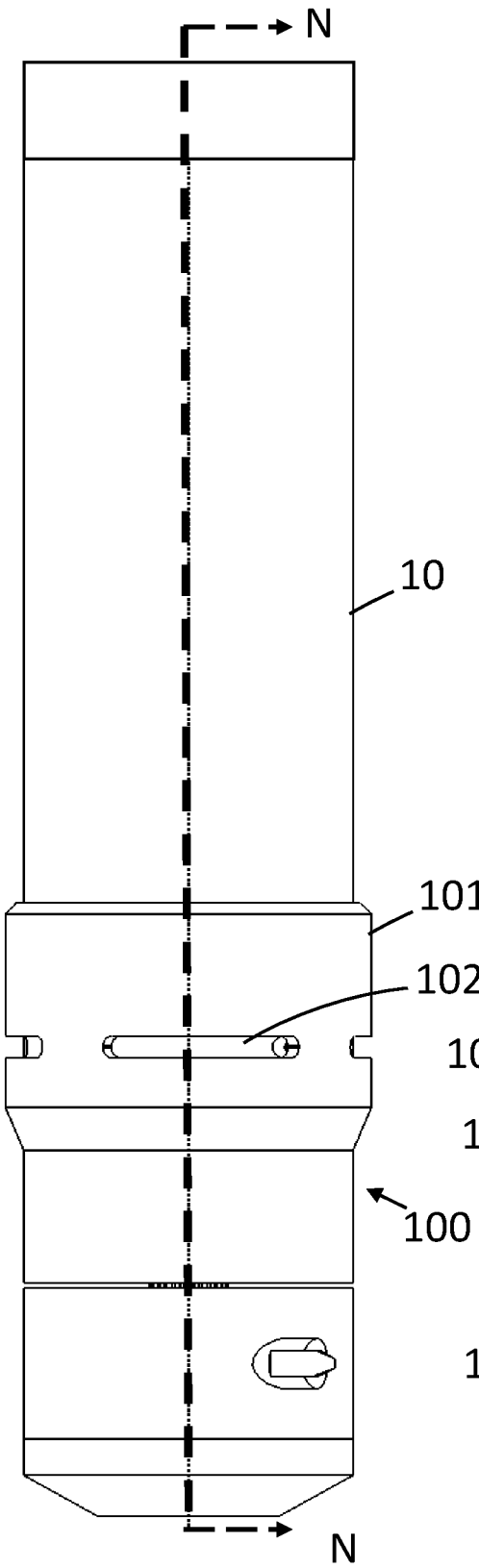
FIG. 22A is a cutting tool including a gearbox.

FIG. 22A is showing a cutting tool 10 including a gearbox 100.

Figure 22B:
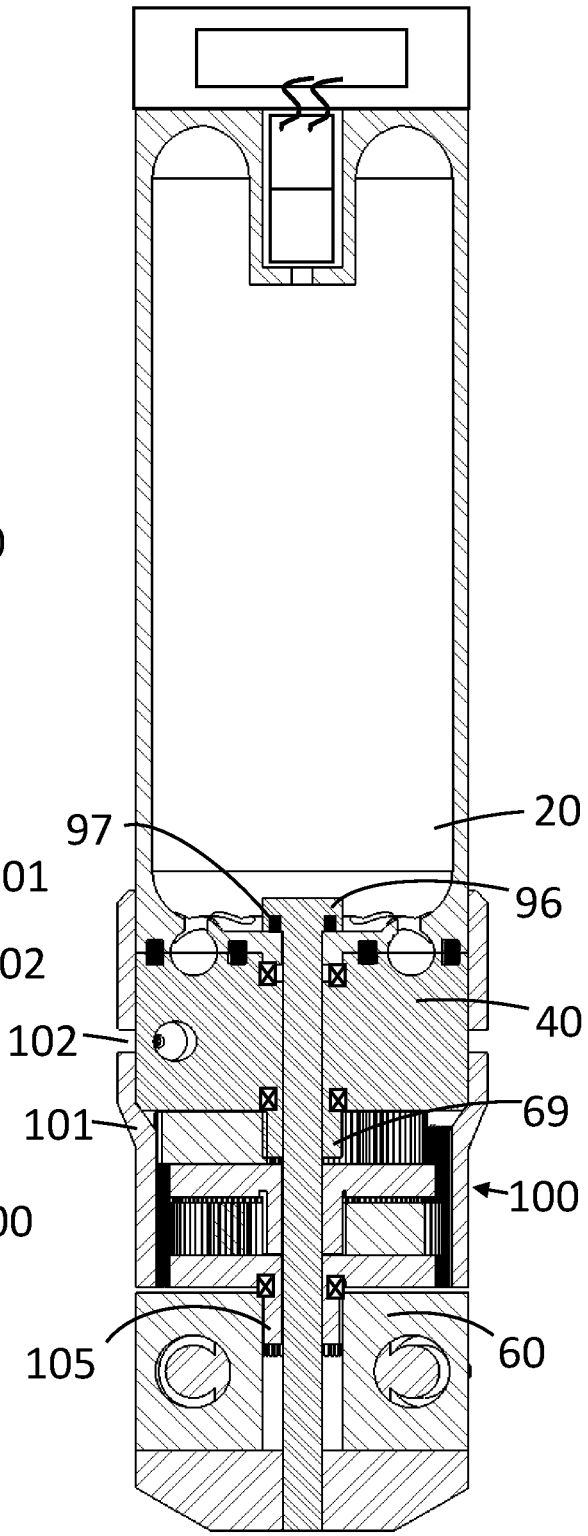
FIG. 22B is a cross-section of FIG. 22A along line N-N.

FIG. 22B is a cross-section of FIG. 22A along line N-N in FIG. 22A. The gearbox 100 is secured to the lower end of pressure chamber 20 by a gearbox housing 101. A gas-driven rotatable motor 40 includes an output pinion 69 which powers the gearbox. The gearbox includes an output shaft 105 which powers the cutting head 60. The gearbox housing 101 includes circumferential gearbox slots 102 which are aligned with the fluid passages 43. A solid shaft 96 is sealed to the lower end of the pressure chamber 20 with seal 97. The solid shaft 96 is disposed through the fluid-powered motor 40 and the gearbox 100 and secures the cutting head 60 to the gearbox output shaft 105.

Figure 23A:
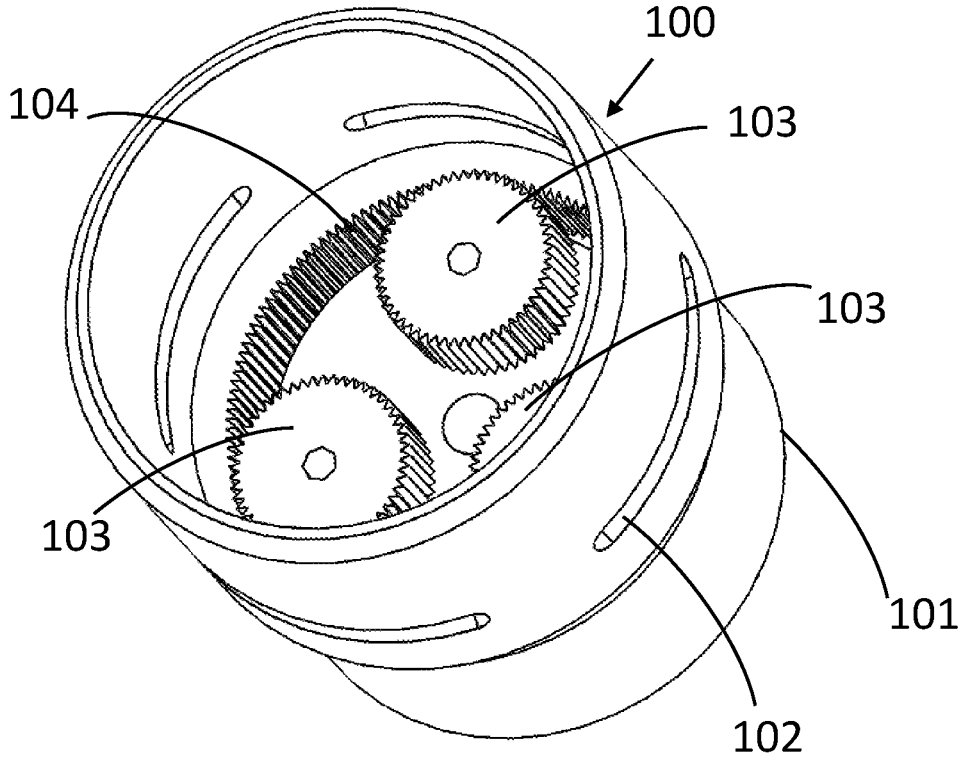
FIG. 23A is an isometric view of a gearbox which may form part of the bottom hole assembly.
Figure 23B:
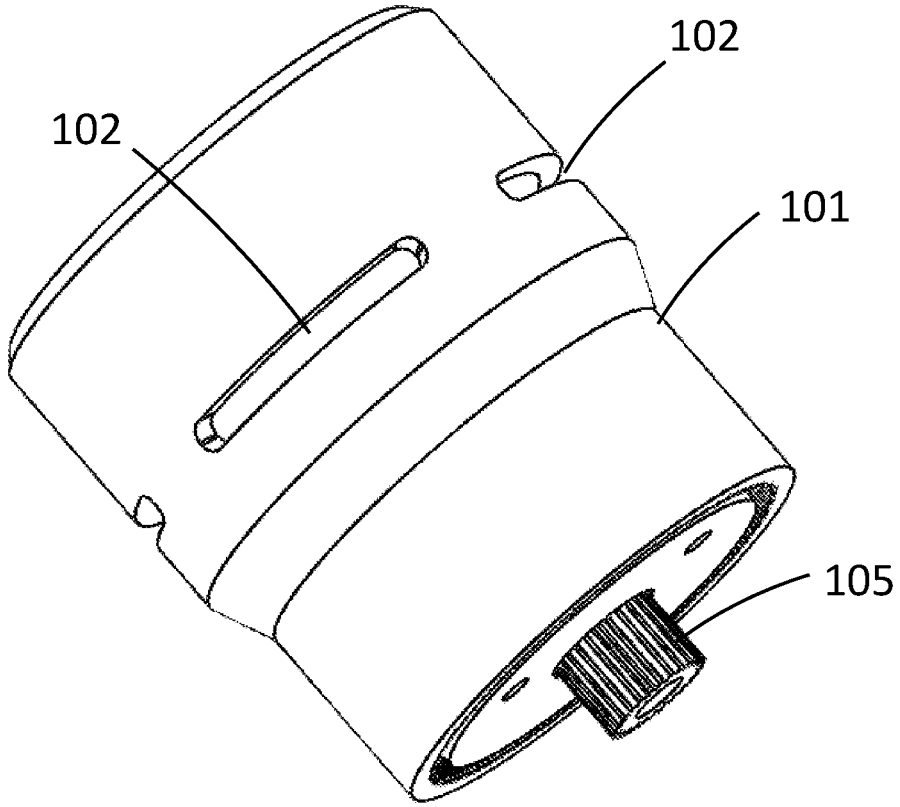
FIG. 23B is an alternate isometric view of the gearbox in FIG. 23A.

FIGS. 23A and 23B are showing detailed views of the gearbox 100, including gearbox housing 100, ring gear 104, planetary gears 103, circumferential gearbox slots 102 and gearbox output shaft 105. The gearbox 100 may function to reduce or increase the rotational speed of the cutting head 60 relative to the gas-driven rotatable motor 40.

Figure 24:
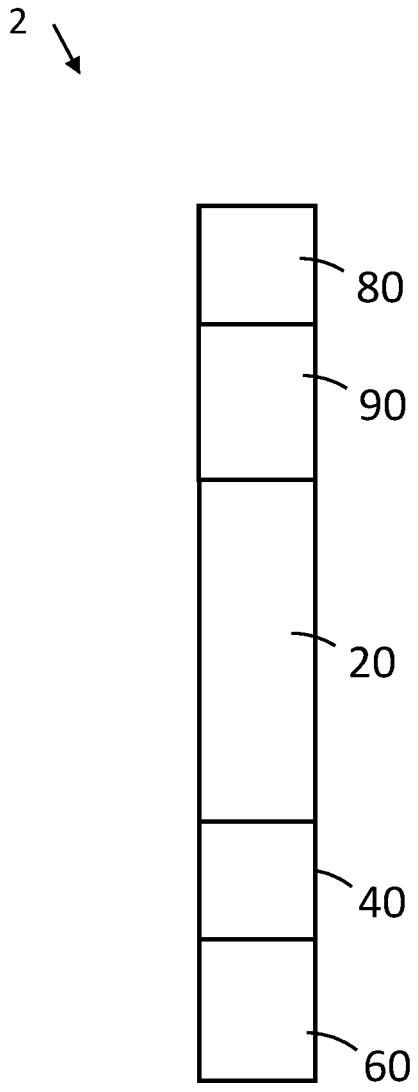
FIG. 24 is a schematic of a bottom hole assembly including a holding tool and a controller module.

FIG. 24 is showing a schematic of a bottom hole assembly 2 including from top to bottom; a control module 80, a holding tool 90, a pressure chamber 20, a fluid-powered motor 40 and a cutting head 60. The components of the bottom hole assembly are the same as in FIG. 21 except that the bottom hole assembly 2 in FIG. 24 does not include a gearbox 100.

Figure 25A:
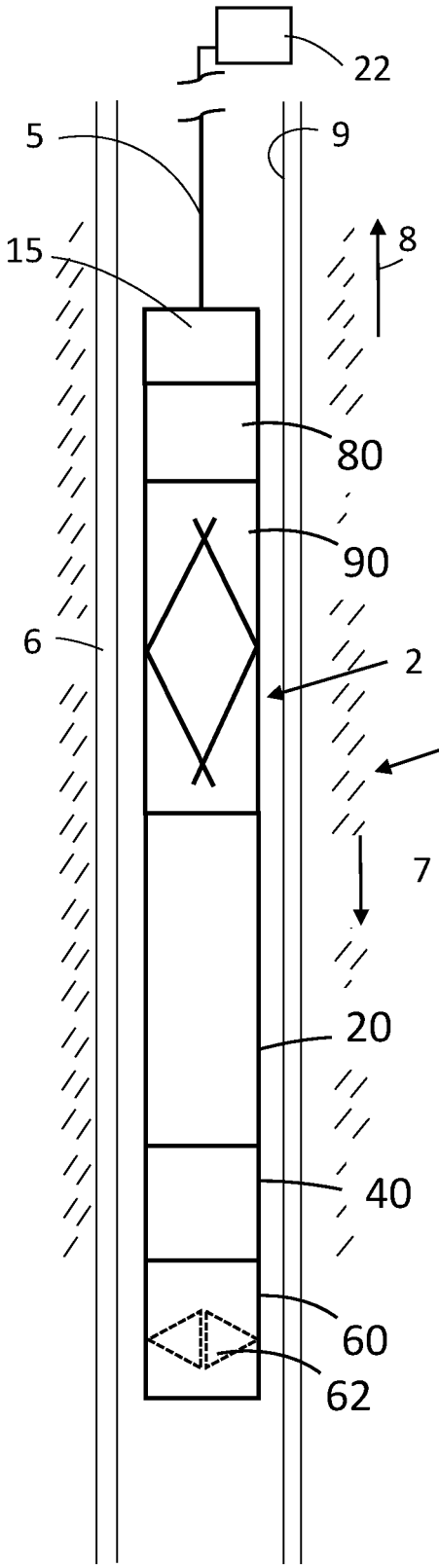
FIG. 25A through 25F are schematics of steps for a method of use of a bottom hole assembly including a cutting tool.

In FIG. 25A it is shown the bottom hole assembly 2 which is deployed by a wireline 5 inside a tubular 6 to a desired location within a subterranean well 4 with its cutters 62 in retracted position, i.e. an initial position within a circumferential envelope of the cutting head 60.

Figure 25B:
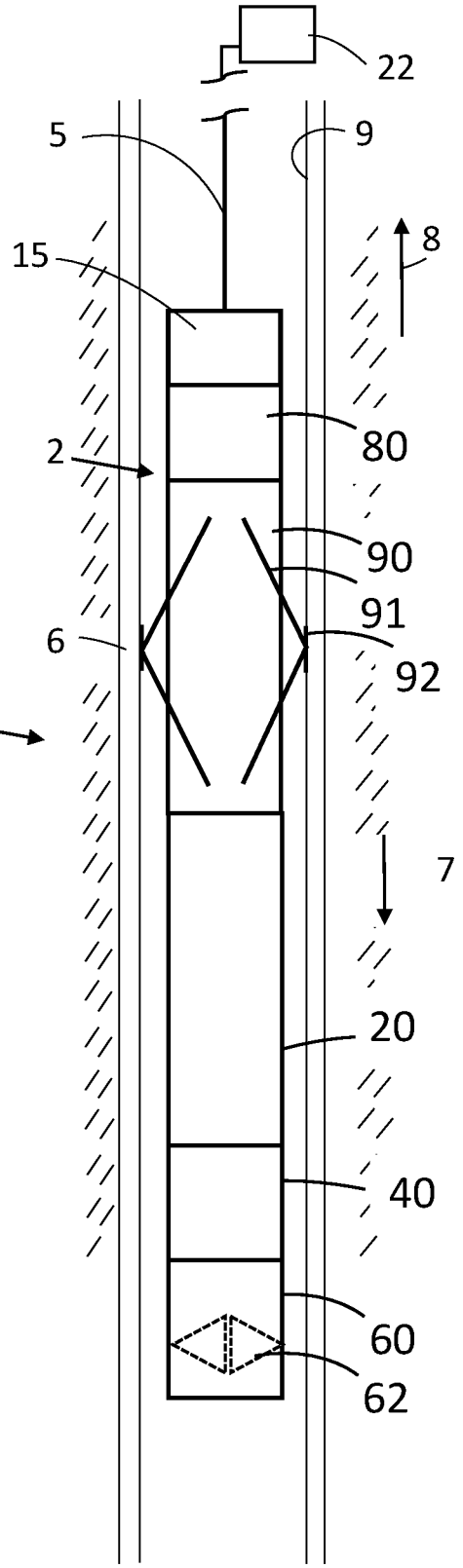

In FIG. 25B is shown the bottom hole assembly 2 at the same location in a subterranean well 4 with, the holding linkages 91 of holding tool 90 actuated to engage holding pads 92 to the inner surface 9 of tubular 6.

Figure 25C:
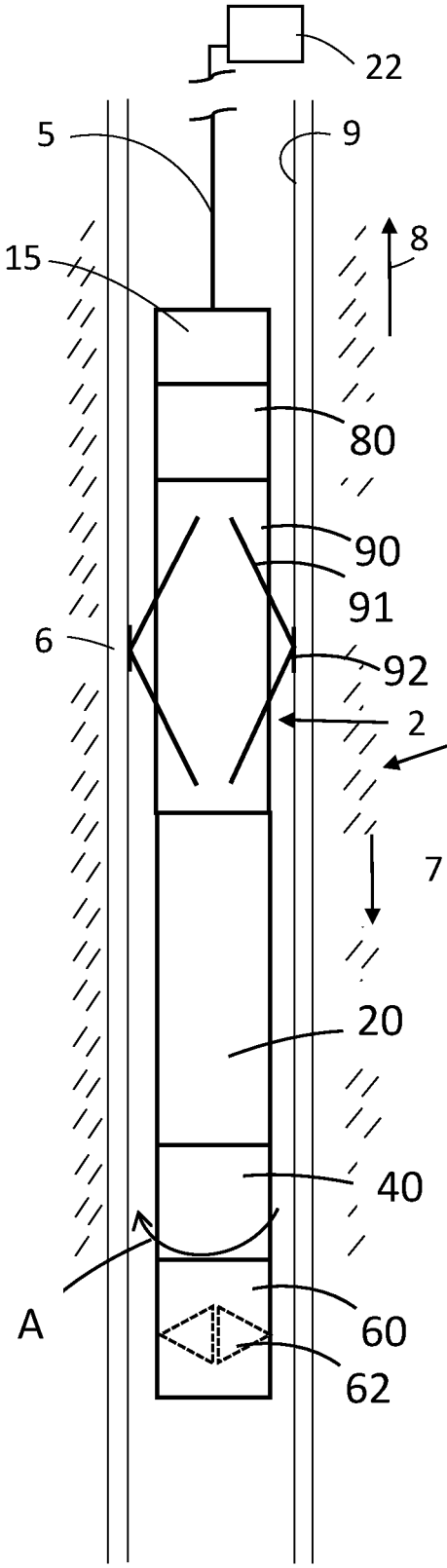

In FIG. 25C is shown the bottom hole assembly 2 at the same location in a subterranean well 4 with, the gas-driven rotatable motor 40 activated in a rotational motion, as indicated by the arrow A.

Figure 25D:
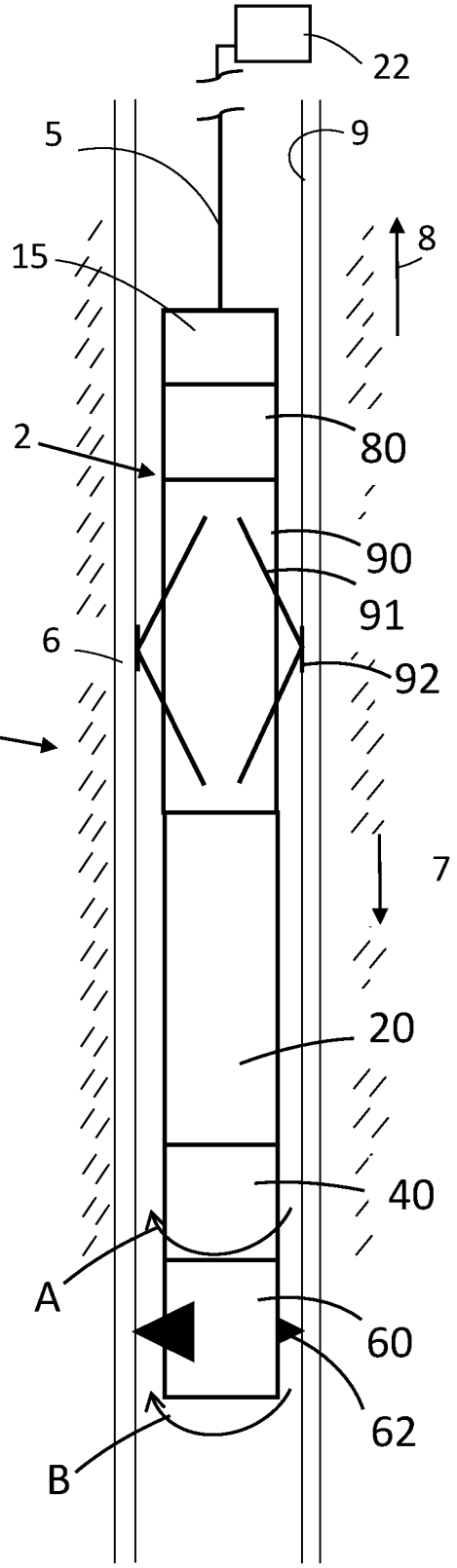

In FIG. 25D is shown the bottom hole assembly 2 at the same location in a subterranean well 4 with the gas-driven rotatable motor 40 and cutting head 60 in a rotational motion (as indicated by arrows A and B) causing the cutters 62 to be extended to cut the tubular 6, i.e. the cutters are outside a circumferential envelope of the cutting head 60.

Figure 25E:
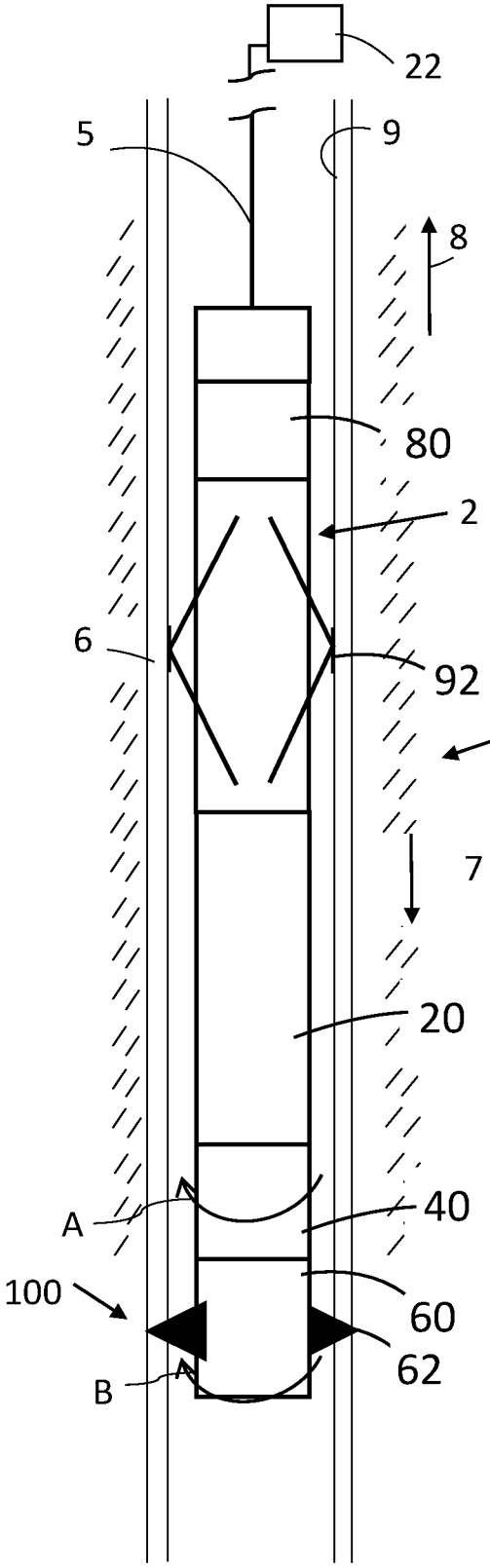

In FIG. 25E is shown the bottom hole assembly 2 at the same location in a subterranean well 4 with gas-driven rotatable motor 40 and the cutting head 60 in a rotational motion causing the cutters 62 severing the tubular 6.

Figure 25F:
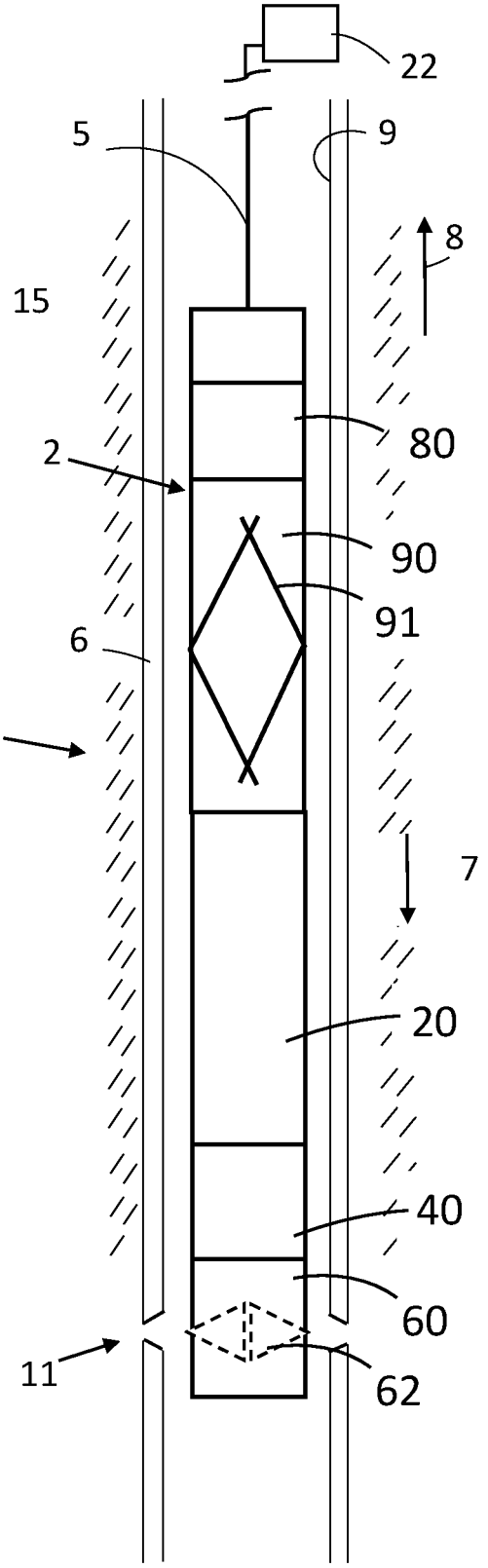

In FIG. 25F is shown the bottom hole assembly 2 at the same location in a subterranean well 4, the tubular 6 has been severed by a cut 11. The rotational motion of the gas-driven rotatable motor 40 and the cutting head 60 has stopped and the cutters 62 are in a retracted position, i.e. in an initial position within a circumferential envelope of the cutting head 60. The holding linkages 91 of holding tool 90 are de-actuated to disengage holding pads 92 from the inner surface 9 of tubular 6.

Figure 26:
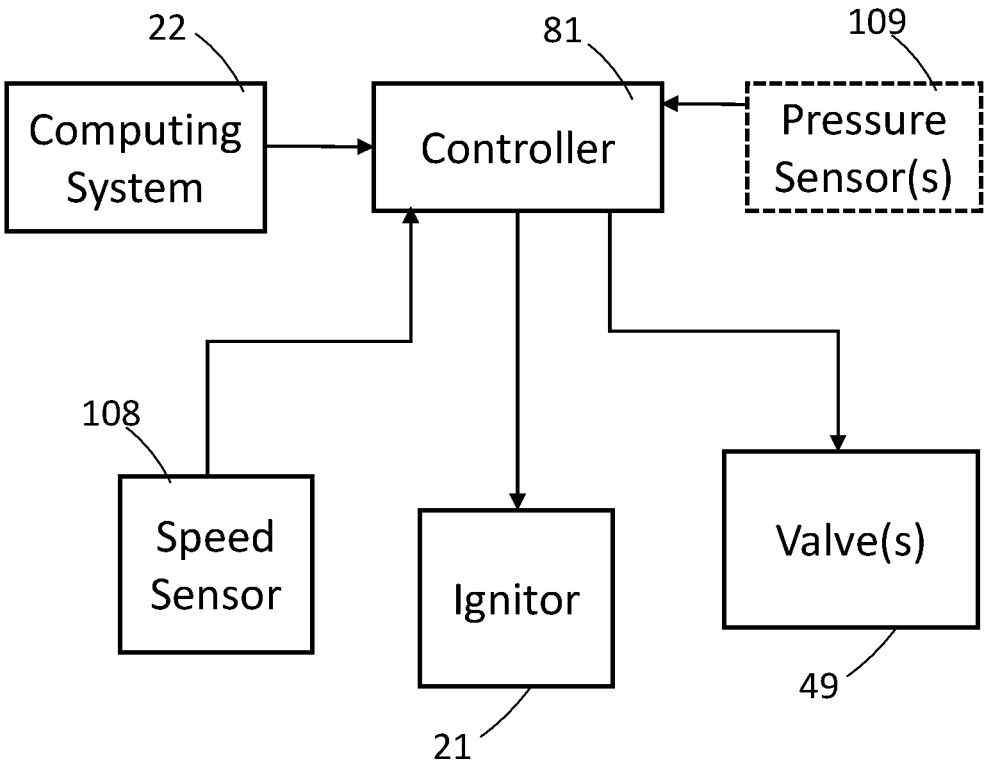
FIG. 26 is signal schematic for a bottom hole assembly including a cutting tool.

FIG. 26 is showing signal schematic for a bottom hole assembly 2 including a cutting tool 10 where an example of operation of the signal schematic will be described in the following in combination with some of the components described above. A propellant 28 is used to generate pressurized fluid 115 in a pressure chamber 20 as the fluid source. An ignitor 21 is in communication with, and may be controlled by, the controller 81. For possibly selectively controlling the flow of pressurized fluid 115 to the gas-driven rotatable motor 40, one or more valve actuators 52 to operate valve 49 may be in communication with, and may be controlled by, the controller 81 for opening and closing the delivery of pressurized fluid 115 to the gas-driven rotatable motor 40, for example. A pressure sensor 109 may be in communication with the controller 81 such that when pressure in a pressure chamber 20 is reduced below a predetermined pressure, the valve actuators 52 may be actuated to close the valve 49 or the cutting operation terminated. A speed sensor 108 may be in communication with the controller 81 as means to detect when a cut 11 in a downhole tubular 6 is complete. For example, while the cutting of a tubular 6 is in process, the speed sensor will communicate the rotational speed of the gas-driven rotatable motor 40 and possibly the cutting head 60 to the controller 81. When the cut 11 is complete, and the speed sensor detects an increase or a change in rotational speed of the gas-driven rotatable motor 40 and/or the cutting head 60, the controller 81 may function to stop the delivery of pressurized fluid 115 to the gas-driven rotatable motor 40 or end the cutting operation. A surface system/computing system 22 may be used to send signals from surface to the downhole controller 81 during a deployment of the bottom hole assembly 2. Additionally, the computing system may be used to pre-program the controller 81 prior to deployment in an operation where surface communication to and from the deployed bottom hole assembly 2 is unavailable. The controller 81 may be an analog circuit or digital processor, such as an application specific integrated circuit (ASIC) or array of field-programmable gate arrays (FPGAs). Accordingly, embodiments may implement any one or more aspects of control logic in the controller 81 that is on-board the cutting tool 10 or in a computing system/surface system 22 that is in data communication with the controller 81. The computing system/surface system 22 may be located at the surface to provide a user-interface for monitoring and controlling the operation of the cutting tool 10 and may be in data communication with the controller 81 over the wireline 5. The control module 80 may receive electrical power through a wireline 5 but it may receive some or all its electrical power from a battery within the bottom hole assembly 2. When receiving electrical power, the controller 81 may activate the ignitor 21 or valve actuator 52 or other electromechanical or electro-hydraulic components within the bottom hole assembly 2 based on a timer, or other set parameters and inputs from within the bottom hole assembly 2, the surrounding well environment or by input from the surface system 22.

Figure 27A:
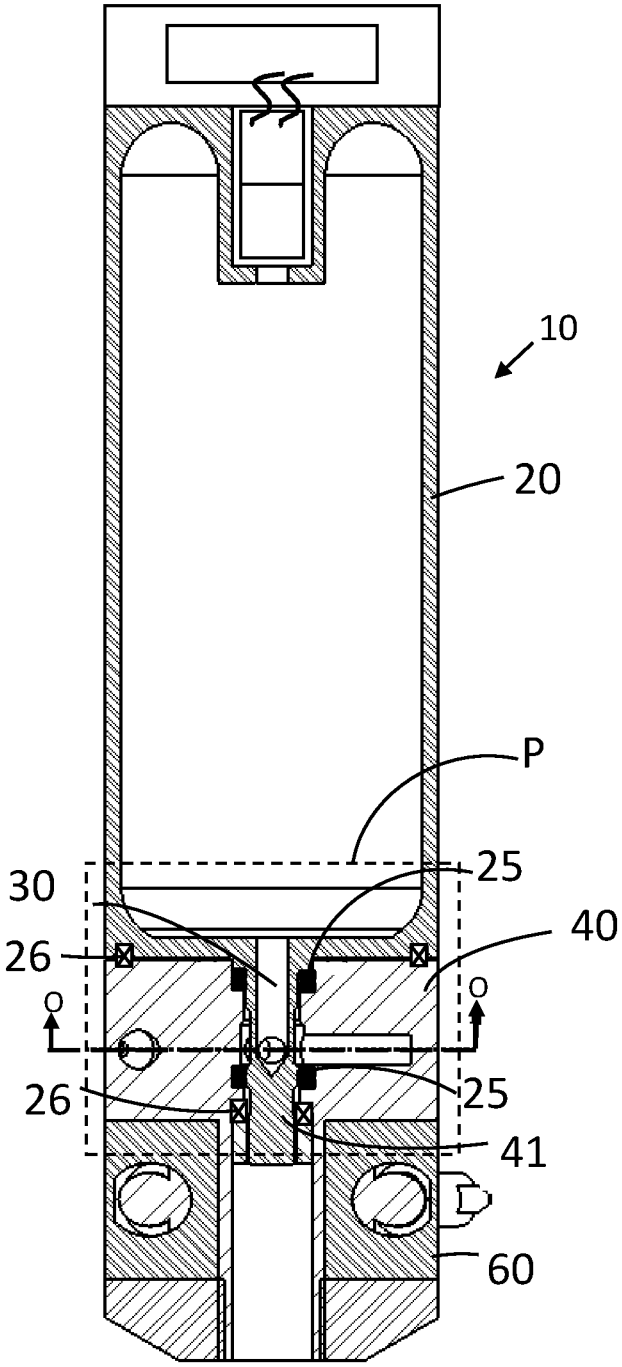
FIG. 27A is a cross-section view of one embodiment of a cutting tool.

FIG. 27A is showing a view of a cutting tool 10 including a pressure chamber 20, a gas-driven rotatable motor 40 and cutting head 60. Gas-driven rotatable motor 40 is disposed to rotate relative to pressure chamber 20 on gas-driven rotatable motor shaft 41 and about bearings 26. Rotary seals 25 facilitate fluid communication from the pressure chamber 20 to the gas-driven rotatable motor 40.

Figure 27B:
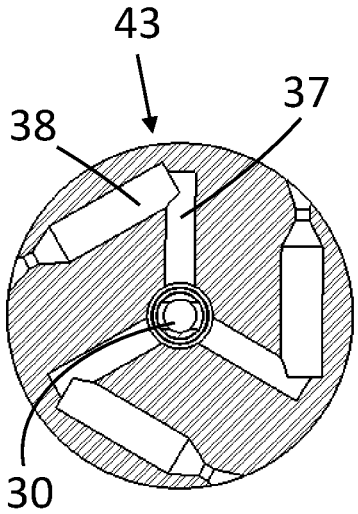
FIG. 27B is a cross-section view of FIG. 27A about line O-O.

FIG. 27B is a cross-section of FIG. 27A along line O-O showing the fluid passage port 30 from the pressure chamber 20 being in fluid communication with the fluid passages 43, each comprising a first portion 37 and a second portion 38.

Figure 28:
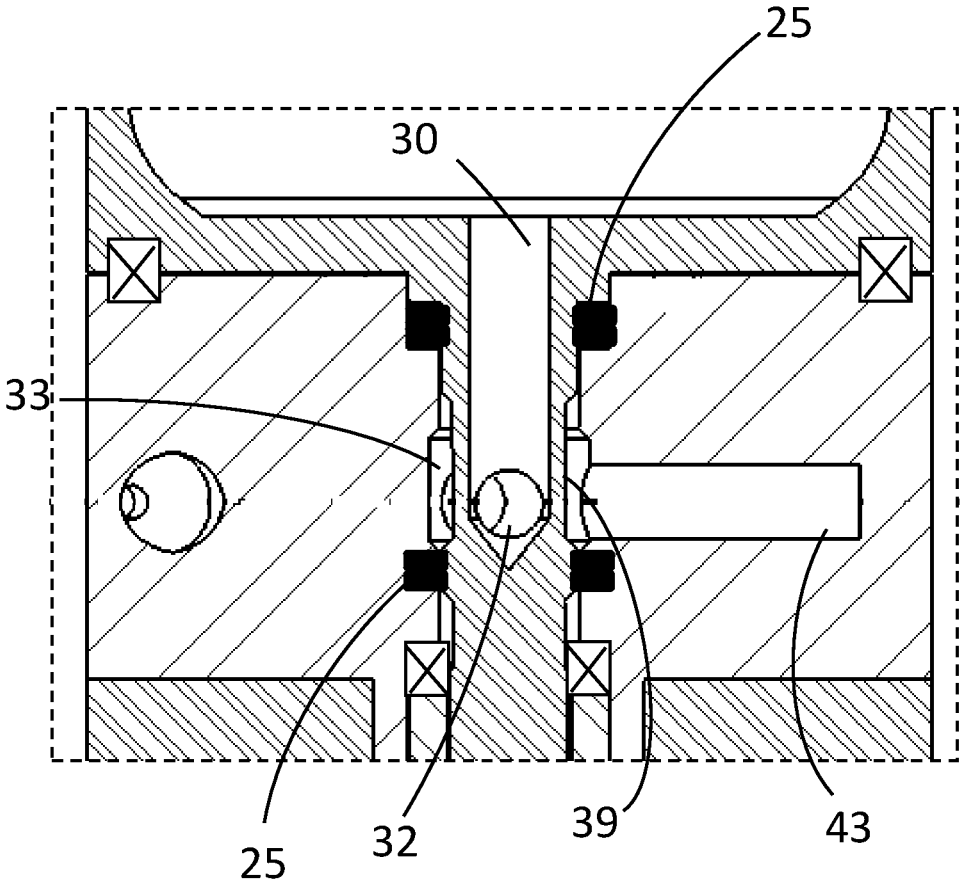
FIG. 28 is a close-up view of an area P of FIG. 27A indicated by the dashed box labelled P on FIG. 27A.

In FIG. 28 it is shown an enlarged section of details in the area marked P in FIG. 27A, which shows that fluid passage port 30 from pressure chamber 20 having fluid communication through fluid passage hole 32 with annular space 33 caused by shaft recess 39. When the pressurized fluid 115 exits from the pressure chamber 20 and passes into annular space 33 it flows into the fluid passages 43, showing that the pressure chamber 20 is fluidically connected to gas-driven rotatable fluid passages 43 which are disposed to exhaust gas, thereby creating rotational motion of the gas-driven rotatable motor 40.

Figure 29:
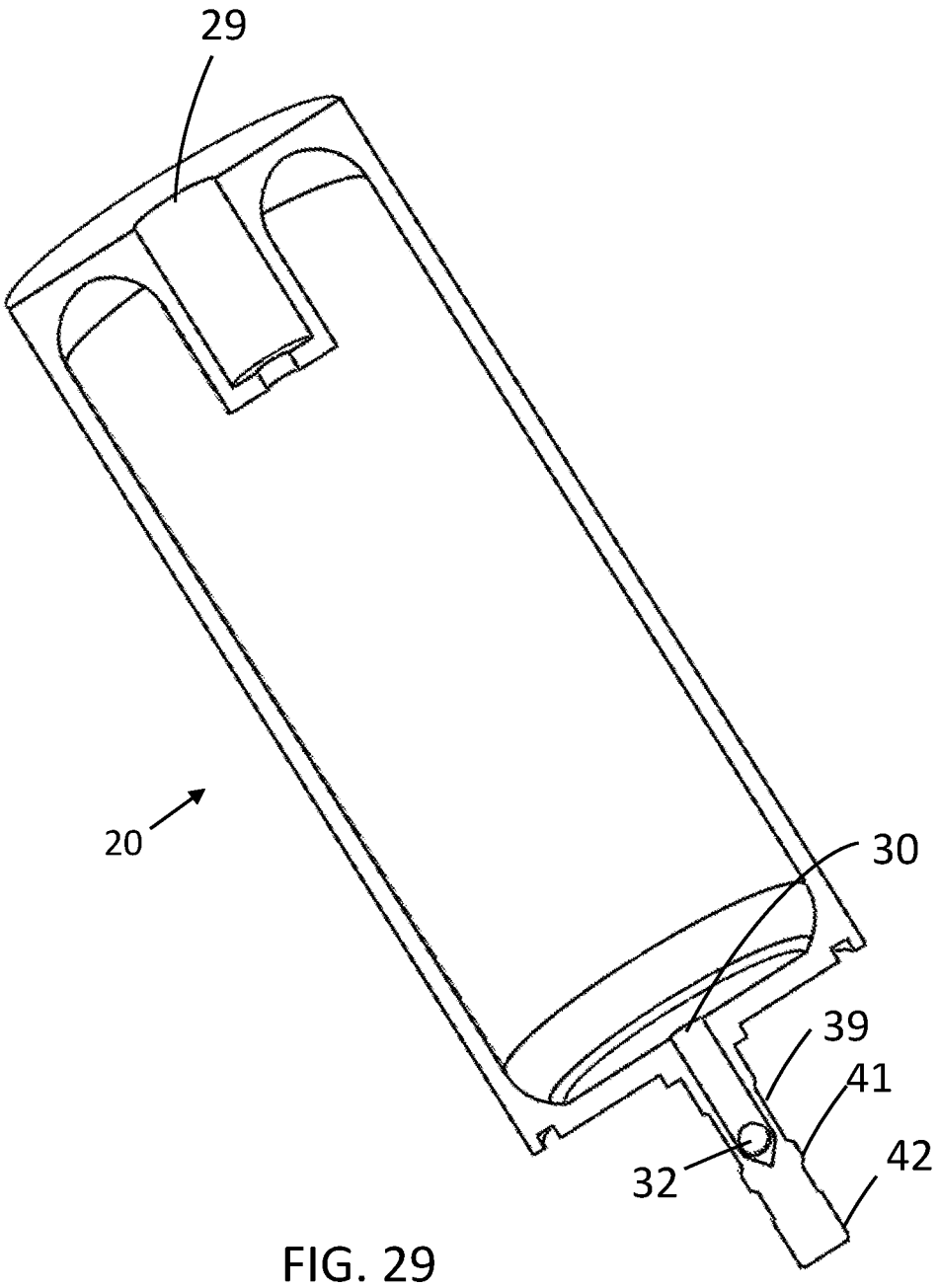
FIG. 29 is one alternative embodiment of a pressure chamber including a gas-driven rotatable motor shaft with a fluid passage hole, a shaft recess, and a threaded end, which may form part of the bottom hole assembly

FIG. 29 shows a component of cutting tool 10, a pressure chamber 20, equipped with propellant holder 29 at the top. At the bottom of pressure chamber 20, pressurized fluid 115 can exit through fluid passage port 30 into fluid passage hole 32. Below pressure chamber 20 is shown gas-driven rotatable motor shaft 41, shaft recess 39 in detail and threaded end 42 of fluid-powered motor shaft 41.

Figure 30:
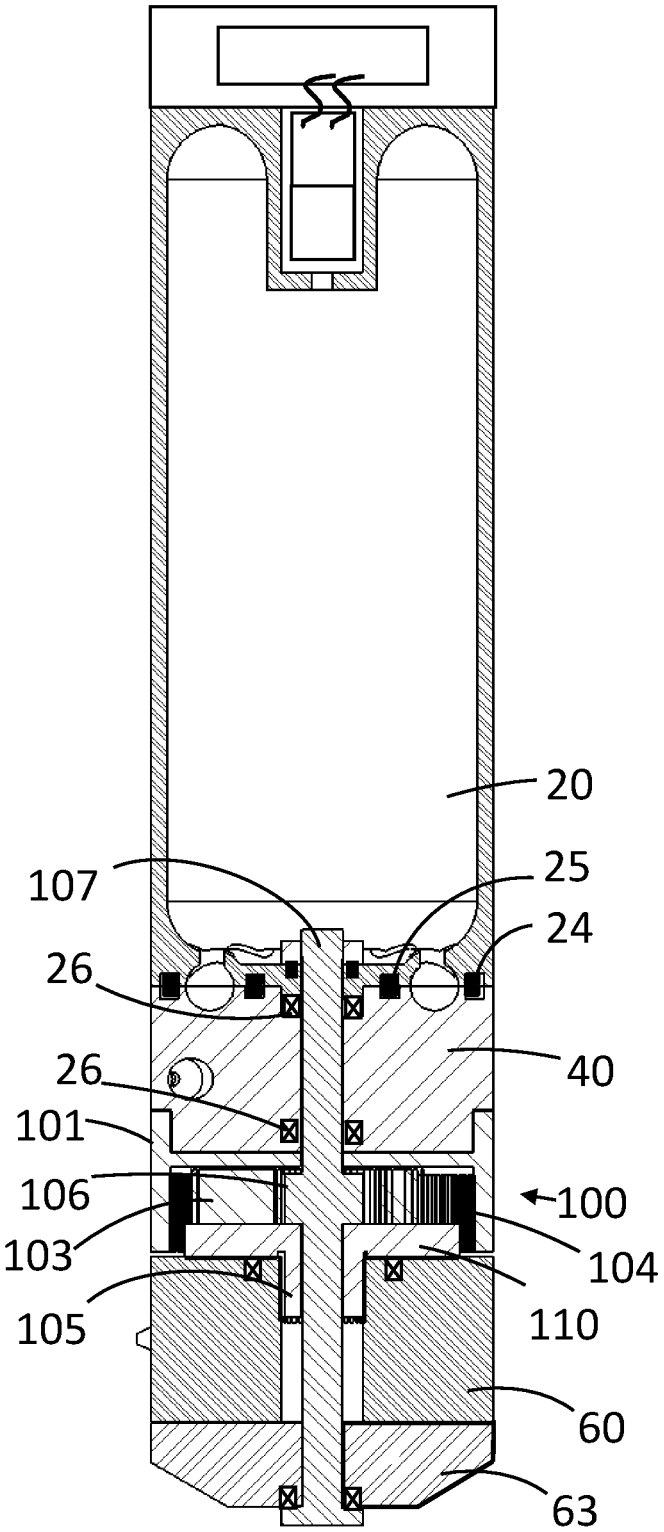
FIG. 30 is a cross-section view of one embodiment of a cutting tool with a through-shaft.

FIG. 30 is showing a cross-section of a cutting tool 10 including a gearbox 100. The sun gear 106 of gearbox 100 is integral with through-shaft 107 which is secured to the lower end of a pressure chamber 20 and the lower end of bottom nut 63. Gearbox housing 101 is integral with ring gear 104 and secured to gas-driven rotatable motor 40. The ring gear 104 is thereby driven by rotation of the gas-driven rotatable motor 40 which in turn drives planetary gears 103 and planetary carrier 110 connected thereto. Gearbox output shaft 105 is integral to planetary carrier 110 and coupled to cutting head 60, such that rotational energy may be transferred from output shaft 105 to cutting head 60.

Figure 31:
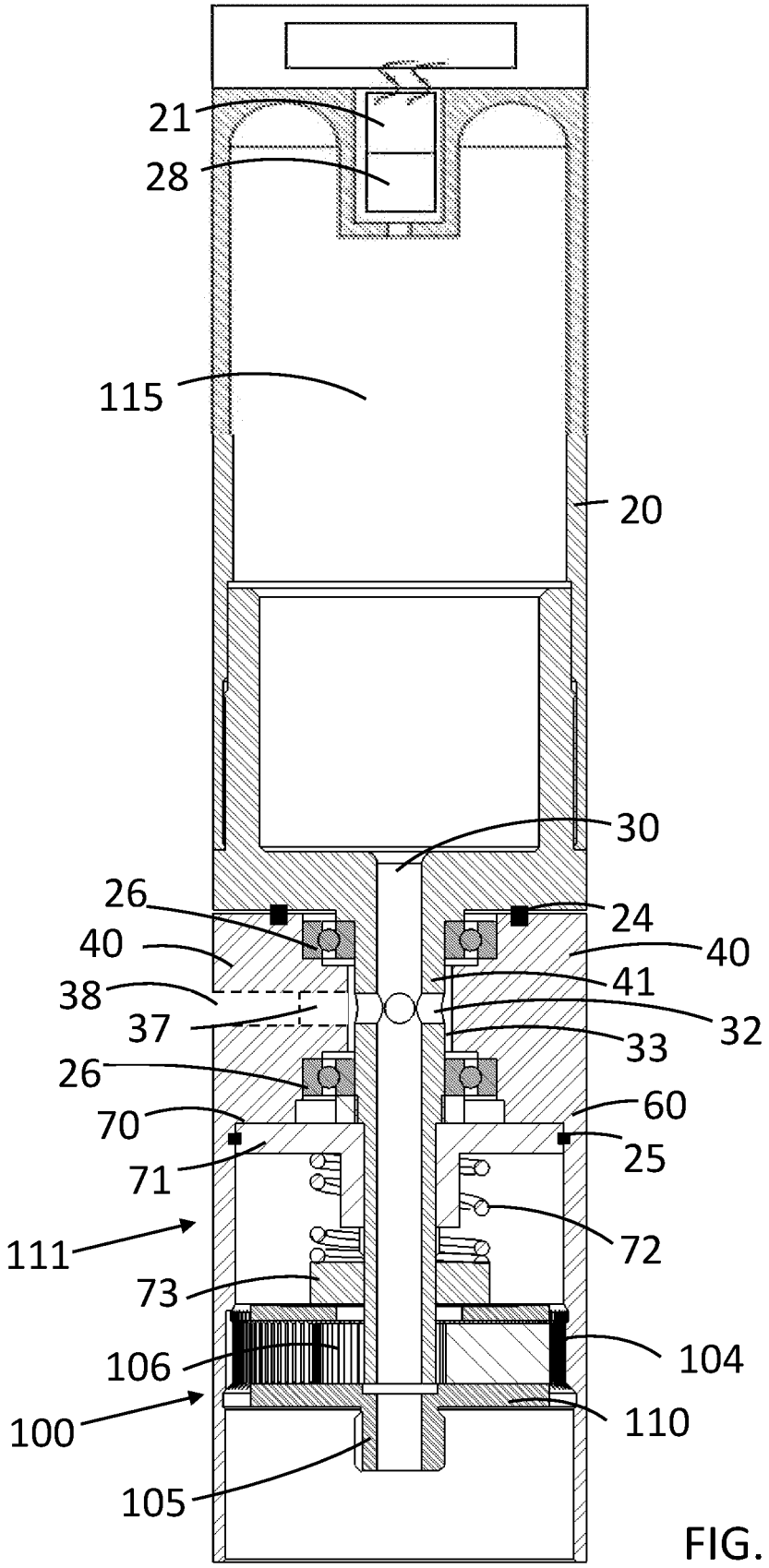
FIG. 31 is a cross-section partial view of an embodiment of a cutting tool with a gas-driven motor biasing mechanism.

FIG. 31 is showing a view of a portion of a cutting tool 10 including a pressure chamber 20, a gas-driven rotatable motor 40 and a gas-driven rotatable motor biasing mechanism, a spring-loaded clutch 111. Gas-driven rotatable motor 40 is disposed to rotate relative to pressure chamber 20 on gas-driven rotatable motor shaft 41 and about bearings 26. Rotary seals 24 and 25 facilitate pressurized gas 115 communication from the pressure chamber 20 to the gas-driven rotatable motor 40.

Pressurized fluid 115 travels into fluid passage port 30 and exits through fluid passage holes 32 and into annular space 33. From annular space 33, fluid is exhausted from the cutting tool via, first portion 37 and second portion 38 of fluid passages 43. At the same time, pressurized fluid 115 travels through lower bearing 26 and applies pressure to clutch plate 71 at interface 70. Clutch spring 72 applies a force to the clutch plate 71 and against spring nut 73 which is fixed to gas-driven rotatable motor shaft 41, and when the pressurized fluid 115 is at a pressure sufficient to overcome the spring force, i.e. at or above the gas-driven rotatable motor set-point pressure, the clutch plate 71 is disengaged from the gas-driven rotatable motor 40 allowing the exhausted fluid to generate a thrust and thereby rotate the gas-driven rotatable motor 40. When pressurized fluid 115 is at a pressure insufficient to overcome the spring force, i.e. at a pressure below the gas-driven rotatable motor set-point pressure, the clutch plate 71 is engaged to the gas-driven rotatable motor 40 and it does not rotate or is in the process of stopping rotation. The gas-driven rotatable motor 40 is integral with ring gear 104 of gearbox 100, while sun gear 106 is integral with gas-driven rotatable motor shaft 41, such that when the gas-driven rotatable motor 40 rotates, the planetary carrier 110 with gearbox output shaft 105 rotates. A cutting head (not shown) may be secured to the output shaft 105 to receive the rotational power from the shaft and for use in a downhole pipe cutting operation.

Figure 32:
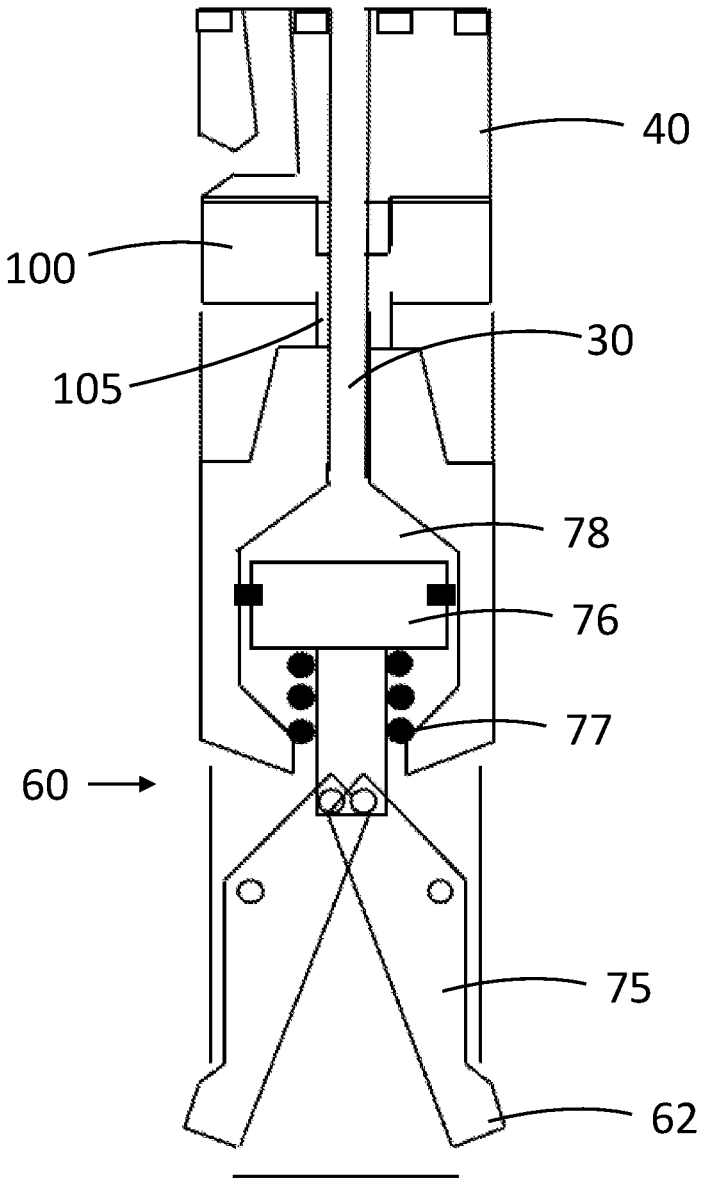
FIG. 32 is a cross-section partial view of an embodiment of a cutting tool with pivoted arms and a pivoted arm biasing mechanism.

FIG. 32 is showing a view of a portion of a cutting tool 10 including a pressure chamber (not shown), a gas-driven rotatable motor 40 a gearbox 100 and a cutting head 60. As shown, FIG. 32 is a cross-section partial view of an embodiment of a cutting tool with pivoted arms and a pivoted arm biasing mechanism. Pressurized fluid 115 travels into fluid passage port 30 from the pressure chamber and into pivoted arm piston chamber 78 and applies pressure to piston 76. When pressurized fluid 115 is at a pressure sufficient to overcome the spring force of pivoted arm return spring 77, i.e. at or above the piston set-point pressure, one or more pivoted arms 75 with cutters 62 attached thereto, may be extended towards the pipe the cutting tool 10 is deployed within; and when the piston 76 is subject to a pressurized gas 115 below the piston set-point pressure, the one or more pivoted arms 75 are in the retracted position or in a process of retracting, and the cutters 62 are not in contact with the pipe.

Figure 33:
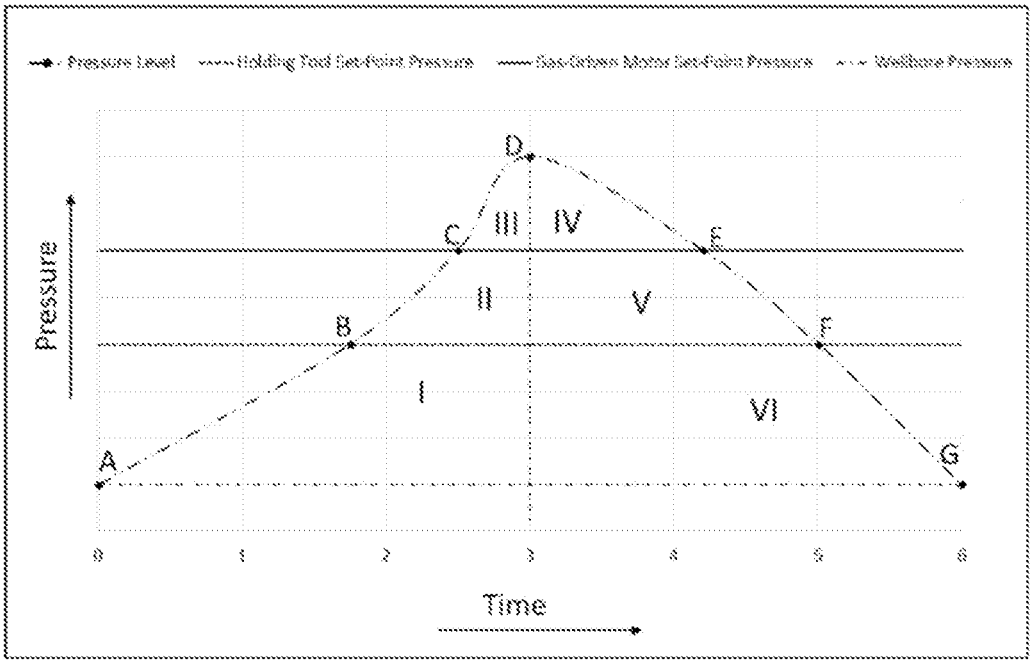
FIG. 33 is a chart of pressure vs. time; schematically showing various pressure set-points, step, and conditions, of the bottom hole assembly.

FIG. 33 is a chart of pressure vs. time; schematically showing various pressure set-points, steps, and conditions, of the bottom hole assembly. Pressure is increasing on the Y-axis and Time in increasing on the X-axis. At step "A" the propellant is ignited while exposed to wellbore pressure (the lowest horizontal line) and the pressure in the pressure chamber is pressurizing (condition I). Near time "2", the holding tool is activated, step "B", when pressurized gas is at the holding tool set-point pressure (the middle of the three horizontal lines). The bottom hole assembly is secured to the tubing and the pressure chamber is further pressurizing (condition II). Near time "2.5" the gas-driven motor is activated, step "C", upon reaching the gas-driven motor set-point pressure. The pressure chamber is further pressurizing, the bottom hole assembly is secured to the tubing and the gas-driven motor is rotating; the cutting tool cutting with a cutting head attached thereto (condition III). At time "3" peak pressure in the pressure chamber is reached. Once peak pressure is achieved, due to the continued exhausting of the pressurized gas from the bottom hole assembly, the pressure of the pressurized gas begins to reduce. The pressure chamber de-pressurizing, the bottom hole assembly is secured to the tubing and the gas-driven motor is rotating; the cutting tool cutting with a cutting head attached thereto (condition IV). The pressure in the pressure chamber then reached the gas-driven motor setpoint pressure just after time "4", step "E", and once the pressure falls below the gas-driven motor set-point pressure, the gas-driven motor is stopped or is then in the process of stopping to rotate. The bottom hole assembly is secured to the tubing and the pressure chamber is further de-pressurizing, (condition V). The pressure in the pressure chamber then reaches the holding tool setpoint pressure at time "5", step "F", and once the pressure falls below the holding tool set-point pressure, the holding tool is de-activated or is in the process of de-activated from engagement with the tubing. The bottom hole assembly is further de-pressurizing, (condition VI) and continues to do so until the pressure in the pressure chamber is equalized to the wellbore pressure at time "6", step "G", and indicated by the lowest horizontal line. It should be noted that the time references indicated in the chart are for illustration purposes only and not indication of actual time during the operation of the bottom hole assembly.

In the preceding description, various aspects of a bottom hole assembly according to the invention have been described with reference to the illustrative embodiments. However, this description is not intended to be construed in a limiting sense. Various modifications and variations of the illustrative embodiment, as well as other embodiments of the system, which are apparent to persons skilled in the art, are deemed to lie within the scope of the present invention as defined by the following claims.

The invention claimed is:

1. A bottom hole assembly for cutting a pipe within a borehole that extends into a subterranean formation, wherein the bottom hole assembly comprises a holding tool for securing the bottom hole assembly to the pipe; and wherein the bottom hole assembly further comprises a cutting tool, and wherein the cutting tool comprises:

a pressure chamber;

a propellant;

an igniter configured to ignite the propellant;

a gas-driven rotatable motor comprising one or more fluid passages wherein each of the fluid passages are in fluid communication with an exterior of the bottom hole assembly;

a mechanical cutting head coupled to the to the gas-driven rotatable motor;

wherein the cutting tool is configured such that upon ignition of the propellant, a pressurized gas is developed in the pressure chamber which is received by the gas-driven rotatable motor, wherein the gas-driven rotatable motor is configured to generate a thrust rotating the motor by exhausting the pressurized gas from the pressure chamber via the one or more fluid passages in the gas-driven rotatable motor to the exterior of the bottom hole assembly.

2. A bottom hole assembly according to claim 1, wherein the holding tool is configured such that upon ignition of the propellant, the pressurized gas is received by the holding tool, thereby securing the bottom hole assembly to the pipe by activating the holding tool from a retracted position to an extended position against the pipe.

3. A bottom hole assembly according to claim 2, wherein the holding tool is biased in the retracted position and arranged such that:

when the holding tool receives the pressurized gas at a pressure at or above a holding tool set-point pressure, the holding tool is forced into the extended position against the pipe; and when the holding tool receives the pressurized gas or the holding tool pressurized gas at a pressure below the holding tool set-point pressure, the holding tool is in the retracted position or in a process of retracting.

4. A bottom hole assembly according to claim 1, further comprising:

a holding tool pressure chamber;

a holding tool propellant;

a holding tool igniter for igniting the holding tool propellant;

wherein the holding tool is configured such that upon ignition of the holding tool propellant, the holding tool propellant generates a holding tool pressurized gas which is received by the holding tool pressure chamber thereby activating the holding tool from a retracted position to an extended position against the pipe.

5. A bottom hole assembly according to claim 4, wherein the holding tool is biased in the retracted position and arranged such that:

when the holding tool receives the holding tool pressurized gas at a pressure at or above a holding tool set-point pressure, the holding tool is forced into the extended position against the pipe; and when the holding tool receives the pressurized gas or the holding tool pressurized gas at a pressure below the holding tool set-point pressure, the holding tool is in the retracted position or in a process of retracting.

6. A bottom hole assembly according to claim 1, wherein the gas-driven rotatable motor and thereby the mechanical cutting head are biased in a stationary position and arranged such that:

when the gas-driven rotatable motor receives the pressurized gas at a pressure above a motor set-point pressure, the gas-driven rotatable motor rotates together with the mechanical cutting head; and when the gas-driven rotatable motor receives the pressurized gas at a pressure below the motor set-point pressure, the gas-driven rotatable motor and thereby the mechanical cutting head does not rotate or is in a process of stopping rotation.

7. A bottom hole assembly according to claim 1, wherein the mechanical cutting head comprises at least one cutter, and wherein the cutter is biased in a retracted position within a circumferential envelope of the cutting head and configured such that:

when the gas-driven rotatable motor and the mechanical cutting head rotate, the at least one cutter is in an extended position against the pipe; and when the gas-driven rotatable motor and the mechanical cutting head do not rotate, the at least one cutter is in the retracted position or in the process of retracting.

8. A bottom hole assembly according to claim 1, wherein the mechanical cutting head comprises a cutter, and wherein the cutter is biased in a retracted position within a circumferential envelope of the cutting head, and configured such that:

when pressurized gas from the pressure chamber applies a pressure to the cutter which is above a cutter set-point pressure, the cutter is in an extended position against the pipe; and when the pressurized gas from the pressure chamber applies a pressure to the cutter which is below the cutter set-point pressure, the at least one cutter is in the retracted position or in a process of retracting.

9. A bottom hole assembly according to claim 1, wherein the mechanical cutting head comprises at least one pivoted arm, wherein each arm is equipped with a cutter and biased in a retracted position within a circumferential envelope of the cutting head, such that:

when the gas-driven rotatable motor and the mechanical cutting head rotate, the at least one pivoted arm is in an extended position against the pipe; and when the gas-driven rotatable motor and the mechanical cutting head do not rotate, the at least one pivoted arm is in the retracted position or in the process of retracting.

10. A bottom hole assembly according to claim 9, wherein the one or more pivoted arms are connected to a piston which is configured to move thereby extending the one or more pivoted arms, and wherein the one or more pivoted arms and the piston are biased in a retracted position within the circumferential envelope of the cutting head, and configured such that:

when the piston is subject to a pressurized gas above a piston set-point pressure, the one or more pivoted arms are in an extended position towards the pipe; and when the piston is subject to a pressurized gas below the piston set-point pressure, the one or more pivoted arms are in the retracted position or in the process of retracting and the cutters are not in contact with the pipe.

11. A bottom hole assembly according to claim 1, wherein each of the one or more fluid passages in the gas-driven rotatable motor comprises a first portion in fluid communication with the pressure chamber and a second portion in fluid communication with the exterior, and wherein each second portion of the one or more fluid passages comprises a center axis and the second portions are spaced apart relative to any other second portion(s) of the other fluid passages, and wherein the center axis of the second portion of each of the one or more fluid passages and a longitudinal axis of the gas-driven rotatable motor are skew lines.

12. A bottom hole assembly according to claim 1, further comprising a gearbox located between the gas-driven rotatable motor and the mechanical cutting head, wherein the gearbox is configured to effectuate a change in a rotational speed of the mechanical cutting head relative to a rotational speed of the gas-driven rotatable motor.

13. A bottom hole assembly according to claim 1, comprising one or more valves for selectively controlling the flow of pressurized gas from the pressure chamber or a holding tool pressure chamber to any one of the following components:

the holding tool, the gas-driven rotatable motor, and the mechanical cutting head, thereby controlling activation and de-activation of said component(s) at their respective set-point pressure and allowing and stopping the flow of pressurized gas to any of said components, and wherein the one or more valves is configured to be in communication with a controller controlling the operation of the one or more valves.

14. A method for cutting a pipe within a borehole using a bottom hole assembly according to claim 1, wherein the method comprises the following steps in sequence:

selecting an amount of propellant based on in situ wellbore pressure and mass of tubular to be cut;

deploying the bottom hole assembly at a given depth within the pipe;

activating and setting the holding tool for securing the bottom hole assembly within the pipe;

igniting the propellant using the igniter and thereby developing a pressurized gas in the pressure chamber;

activating the gas-driven rotatable motor by providing the pressurized gas from the pressure chamber to the gas-driven rotatable motor and exhausting the pressurized gas from the gas-driven rotatable motor to an exterior of the bottom hole assembly, thereby rotating the gas-driven rotatable motor and the mechanical cutting head when the pressure in the pressure chamber is at or above a motor set-point pressure;

cutting the pipe mechanically by rotation of the gas-driven rotatable motor and the mechanical cutting head;

deactivating the rotation of the gas-driven rotatable motor and thereby the mechanical cutting head when the pressurized gas declines to a pressure below the motor set-point pressure due to exhausting the pressurized gas from the gas-driven rotatable motor to the exterior of the of the bottom hole assembly;

deactivating the holding tool;

pulling out the bottom hole assembly from the borehole.

15. The method according to claim 14, wherein the igniting step occurs prior to the step of activating and setting the holding tool, the method further comprising:

utilizing the gas from the pressure chamber for activating and setting the holding tool when the pressurized gas in the pressure chamber is at or above a holding tool set-point pressure, and wherein deactivating the holding tool occurs when the pressure in the pressure chamber is below the holding tool set-point pressure.

16. The method according to claim 14 wherein the bottom hole assembly further comprises a holding tool pressure chamber, a holding tool propellant and an igniter for igniting the holding tool propellant; the method further comprising the steps of:

igniting the holding tool propellant to develop a holding tool pressurized gas inside the holding tool pressure chamber-utilizing the gas from the holding tool pressure chamber for activating and setting the holding tool when the holding tool pressurized gas in the holding tool pressure chamber is at or above a holding tool set-point pressure, and wherein deactivating the holding tool occurs when the pressure in the holding tool pressure chamber is below the holding tool set-point pressure.

* * * * *